US010431045B2

(12) United States Patent
Yamamori et al.

(10) Patent No.: US 10,431,045 B2
(45) Date of Patent: Oct. 1, 2019

(54) GAME APPARATUS, GAME METHOD AND GAME PROGRAM

(71) Applicant: KONAMI DIGITAL ENTERTAINMENT CO., LTD., Tokyo (JP)

(72) Inventors: Masakazu Yamamori, Tokyo (JP); Yosuke Sasaki, Tokyo (JP)

(73) Assignee: KONAMI DIGITAL ENTERTAINMENT CO., LTD., Tokyo (JP)

( * ) Notice: Subject to any disclaimer, the term of this patent is extended or adjusted under 35 U.S.C. 154(b) by 0 days.

(21) Appl. No.: 15/582,837

(22) Filed: May 1, 2017

(65) Prior Publication Data

US 2017/0337772 A1 Nov. 23, 2017

(30) Foreign Application Priority Data

May 18, 2016 (JP) ..... 2016-099342

(51) Int. Cl.
*A63F 9/00* (2006.01)
*G07F 17/32* (2006.01)
*G07F 17/34* (2006.01)

(52) U.S. Cl.
CPC ..... *G07F 17/3262* (2013.01); *G07F 17/3213* (2013.01); *G07F 17/3227* (2013.01); *G07F 17/34* (2013.01)

(58) Field of Classification Search
None
See application file for complete search history.

(56) References Cited

U.S. PATENT DOCUMENTS 8,870,642 B2 * 10/2014 Leupp ..... G07F 17/34 463/16
9,299,224 B2 * 3/2016 Leupp ..... G07F 17/34
(Continued)

FOREIGN PATENT DOCUMENTS

JP 2007167226 A 7/2007
JP 2008228894 A 10/2008
JP 2009-061100 A 3/2009

OTHER PUBLICATIONS

Communication dated Feb. 6, 2018, from Japanese Patent Office in counterpart application No. 2016-099342.
(Continued)

*Primary Examiner* — Seng Heng Lim
(74) *Attorney, Agent, or Firm* — Sughrue Mion, PLLC

(57) ABSTRACT

A game apparatus includes a symbol arrangement device, a replacement symbol drawing device, a symbol replacement device, and a win determination device. The symbol arrangement device is configured to arrange a plurality of symbols in a predefined area. The replacement symbol drawing device is configured to draw at least one replacement target symbol to be replaced. The symbol replacement device is configured to replace, with at least alternative symbol, the at least one replacement target symbol that was drawn, after the symbol arrangement device arranged at least one of the plurality of symbols. The win determination device is configured to perform a win determination based at least in part on an arrangement of symbols which are in at least a part of the predefined area, after the symbol replacement device replaced, by the at least alternative symbol, the at least one replacement target symbol that was drawn.

18 Claims, 20 Drawing Sheets

(56) References Cited

U.S. PATENT DOCUMENTS 9,460,587 B2 * 10/2016 Saunders ..... G07F 17/34
9,472,065 B2 * 10/2016 Nicely ..... G07F 17/34
9,805,556 B2 * 10/2017 Lee ..... G07F 17/326
2004/0033829 A1 * 2/2004 Pacey ..... G07F 17/3265 463/20
2008/0051174 A1 * 2/2008 Fiden ..... G07F 17/34 463/20
2009/0075722 A1 * 3/2009 Louie ..... G07F 17/32 463/20
2009/0117971 A1 * 5/2009 Yoshizawa ..... G07F 17/32 463/20
2009/0124325 A1 * 5/2009 Wadleigh ..... G07F 17/3267 463/20
2009/0247268 A1 * 10/2009 Yoshizawa ..... G07F 17/3202 463/20
2010/0004049 A1 * 1/2010 Ching ..... G07F 17/3267 463/20
2013/0316787 A1 * 11/2013 Hughes ..... G07F 17/3265 463/20
2013/0331173 A1 * 12/2013 Jaffe ..... G07F 17/3267 463/21
2014/0309011 A1 * 10/2014 Pawloski ..... G07F 17/34 463/20
2014/0329591 A1 * 11/2014 Caputo ..... G07F 17/3267 463/29
2014/0349737 A1 * 11/2014 Meyer ..... G07F 17/326 463/20
2014/0357342 A1 * 12/2014 Elias ..... G07F 17/32 463/20
2014/0364193 A1 * 12/2014 Williamson ..... G07F 17/326 463/21
2015/0087385 A1 * 3/2015 Shiraishi ..... G07F 17/34 463/20
2015/0141114 A1 * 5/2015 Davis ..... G07F 17/3213 463/20
2015/0170462 A1 * 6/2015 Berman ..... G07F 17/3213 463/20
2015/0235510 A1 * 8/2015 Meyer ..... G07F 17/3213 463/20
2015/0310699 A1 * 10/2015 Meyer ..... G07F 17/34 463/20
2015/0339880 A1 * 11/2015 Zurawski ..... G07F 17/34 463/20
2016/0055705 A1 * 2/2016 Elias ..... G07F 17/34 463/20
2016/0140794 A1 * 5/2016 Tanner ..... G07F 17/34 463/20
2016/0351005 A1 * 12/2016 Igesund ..... G07F 17/3213

OTHER PUBLICATIONS

Communication dated Oct. 3, 2017, issued by the Japan Patent Office in corresponding Japanese Application No. 2016-099342.

* cited by examiner

FIG. 5

| SYMBOL | VALUE | PROBABILITY OF APPEARANCE |
|---|---|---|
| PLUM | 1 | ・・・ |
| ORANGE | 1 | ・・・ |
| CHERRY | 2 | ・・・ |
| MELON | 3 | ・・・ |
| BELL | 4 | ・・・ |
| BAR1 | 5 | ・・・ |
| BAR2 | 6 | ・・・ |
| BAR3 | 7 | ・・・ |
| BLUE 7 | 8 | ・・・ |
| RED 7 | 8 | ・・・ |
| ・・・ | ・・・ | ・・・ |

FIG. 6

| NUMBER OF SYMBOL TYPES | REPLACEMENT TARGET SYMBOL | PROBABILITY | REPLACEMENT TARGET SYMBOL | PROBABILITY | REPLACEMENT TARGET SYMBOL | PROBABILITY |
|---|---|---|---|---|---|---|
| 1 | PLUM | a% | ORANGE | b% | CHERRY | c% |
| 2 | PLUM + ORANGE | d% | PLUM + CHERRY | e% | ORANGE + CHERRY | f% |
| 3 | PLUM + ORANGE + CHERRY | 100% | | | | |

FIG. 7

| NUMBER OF SYMBOL TYPES | LOSE | 1 | 2 | 3 |
|---|---|---|---|---|
| PROBABILITY | a% | b% | c% | d% |

| ALTERNATIVE SYMBOL | RED 7 | BLUE 7 | BAR3 | BAR2 | BAR1 | BELL | MELON | PLUM |
|---|---|---|---|---|---|---|---|---|
| PROBABILITY | a% | b% | c% | d% | e% | f% | g% | h% |

| NUMBER OF SYMBOL TYPES | LOSE | 1 | 2 | 3 |
|---|---|---|---|---|
| PROBABILITY | a% | b% | c% | d% |

FIG. 26

| NUMBER OF SYMBOL TYPES | SYMBOL APPEARING | PROBABILITY | ALTERNATIVE SYMBOL | PROBABILITY | ALTERNATIVE SYMBOL | PROBABILITY | ALTERNATIVE SYMBOL | PROBABILITY | ALTERNATIVE SYMBOL | PROBABILITY |
|---|---|---|---|---|---|---|---|---|---|---|
| 1 | WILD | a% | FREE | b% | BLUE STEP | c% | RED STEP | d% | | |
| 2 | FREE × 2 | e% | WILD + BLUE STEP | f% | WILD + RED STEP | g% | FREE + BLUE STEP | h% | FREE + RED STEP | i% |
| 3 | FREE × 3 | j% | FREE×2 + BLUE STEP | k% | FREE× 2 + RED STEP | l% | | | | |

GAME APPARATUS, GAME METHOD AND GAME PROGRAM

TECHNICAL FIELD

Embodiments of the present invention generally relate to a game apparatus, a game method and a game program.

BACKGROUND ART

Japanese Patent Application Publication No. 2009-61100 discloses a slot machine, wherein when a specific symbol is displayed; the symbol is replaced by a scatter symbol. The slot machine using limited replacement symbols as targets for replacement will not provide unexpectedness or variety regarding symbol replacement.

SUMMARY

In some aspects, a game apparatus may include, but is not limited to, a symbol arrangement device, a replacement symbol drawing device, a symbol replacement device, and a win determination device. The symbol arrangement device is configured to arrange a plurality of symbols in a predefined area. The replacement symbol drawing device is configured to draw at least one replacement target symbol to be replaced. The symbol replacement device is configured to replace, with at least alternative symbol, the at least one replacement target symbol that was drawn, after the symbol arrangement device arranged at least one of the plurality of symbols. The win determination device is configured to perform a win determination based at least in part on an arrangement of symbols which are in at least a part of the predefined area, after the symbol replacement device replaced, by the at least alternative symbol, the at least one replacement target symbol that was drawn.

BRIEF DESCRIPTION OF THE DRAWINGS

FIG. 5 shows an example of symbol data.

FIG. 6 shows an example of settings of the drawing probabilities when a drawing is made for the types of the replacement target symbols.

FIG. 7 shows an example of settings of the drawing probabilities when a drawing is made for the number of types of the replacement target symbols.

FIG. 26 shows an example of the settings of the drawing probabilities when a drawing is made of the alternative symbol types in the reserved area.

DETAILED DESCRIPTIONS

Figure 1:
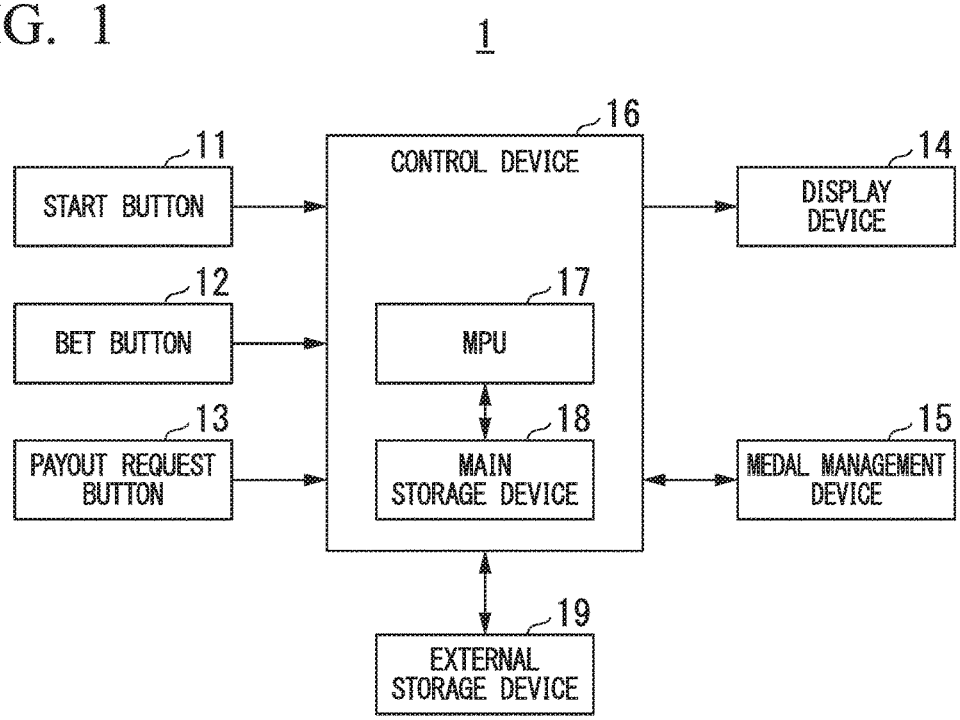
FIG. 1 is a block diagram showing an example of the general configuration of a game apparatus according to a first embodiment.

In some aspects, a game apparatus may include, but is not limited to, a symbol arrangement device, a replacement symbol drawing device, a symbol replacement device, and a win determination device. The symbol arrangement device is configured to arrange a plurality of symbols in a predefined area. The replacement symbol drawing device is configured to draw at least one replacement target symbol to be replaced. The symbol replacement device is configured to replace, with at least alternative symbol, the at least one replacement target symbol that was drawn, after the symbol arrangement device arranged at least one of the plurality of symbols. The win determination device is configured to perform a win determination based at least in part on an arrangement of symbols which are in at least a part of the predefined area, after the symbol replacement device replaced, by the at least alternative symbol, the at least one replacement target symbol that was drawn.

In some cases, the replacement symbol drawing device may be configured to draw the at least one replacement target symbol from symbols of different types.

In some cases, the replacement symbol drawing device may be configured to draw the number of types of the replacement target symbols, and draw symbols of the drawn number of types from the plurality of symbols.

In some cases, the replacement symbol drawing device may be configured to draw at least one position of the at least one replacement target symbol in the predefined area.

In some cases, the replacement symbol drawing device may be configured to draw the number of the at least one position of the at least one replacement target symbol in the predefined area, and draw the at least one positions of which number is the drawn number.

In some cases, the game apparatus may further include, but is not limited to, an alternative symbol drawing device that is configured to draw the at least alternative symbol which is to be replaced for the at least one replacement target symbol.

In some cases, the alternative symbol drawing device may be configured to draw a type of the at least alternative symbol which is to be replaced for the at least one replacement target symbol.

In some cases, the alternative symbol drawing device may be configured to draw types of the at least one alternative symbols, the number of types of the at least one alternative symbols is equal to or smaller than the number of the types of the at least one replacement target symbol.

In some cases, the alternative symbol drawing device may be configured to draw a type of the alternative symbol which is equal to or higher in value than the at least one replacement target symbol.

In some cases, the game apparatus may further include, but is not limited to, a replacement condition determination device that is configured to determine whether there is satisfied a replacement condition for the symbol arrangement device to replace symbol. The replacement symbol drawing device may be configured to draw the at least one replacement target symbol in case that the replacement condition determination device determined that the replacement condition is satisfied.

In some cases, the predefined area may include, but is not limited to, a first area on which a first replacement condition is set as the replacement condition and a second area on which a second replacement condition is set as the replacement condition. The replacement condition determination device may be configured to determine whether the first replacement condition is satisfied and whether the second replacement condition is satisfied. The replacement symbol drawing device may be configured to draw the at least one replacement target symbol in the first area in case that the replacement condition determination device determined that the first replacement condition is satisfied. The replacement symbol drawing device may be configured to draw the at least one replacement target symbol in the second area in case that the replacement condition determination device determined that the second replacement condition is satisfied.

In some cases, the symbol replacement device may be configured to replace, with at least alternative symbol, the at least one replacement target symbol that was drawn in the first area at a first timing. The symbol replacement device may be configured to replace, with at least alternative symbol, the at least one replacement target symbol that was drawn in the second area at a second timing which is different from the first timing.

In some cases, the win determination device may be configured to perform the win determinations before and after the symbol replacement device replaces, with at least alternative symbol, the at least one replacement target symbol that was drawn.

In some cases, the predefined area may include, but is not limited to, a win determination target area for the win determination and a win determination non-target not for the win determination. The game apparatus further may include, but is not limited to, a symbol moving device configured to move a symbol in the win determination non-target area into the win determination non-target area. The symbol replacement device may be configured to perform the symbol replacement in the win determination non-target area before the symbol moving device moves the symbol replaced in the win determination non-target area into the win determination non-target area.

In some cases, the replacement condition determination device may be configured to determine whether the replacement condition is satisfied, based at least in part on symbols which are arranged in at least a part of the predefined area by the symbol arrangement device.

In some cases, the replacement condition determination device may be configured to update at least one parameter in case that the symbol arrangement device arranges specific symbols at least a part of the predefined area, and to determine whether the replacement condition is satisfied, based at least in part on a comparison between the at least one parameter and at least one predefined reference value.

In some cases, the game apparatus may further include, but is not limited to, a display control device configured to have a display device display a first result of drawing the at least one alternative symbol and a second result of drawing the at least one replacement symbol, wherein a first one of the first and second results is displayed before a second one of the first and second results is displayed.

In other aspects, a gaming method may further include, but is not limited to, arranging a plurality of symbols in a predefined area; drawing at least one replacement target symbol to be replaced; replacing, with at least alternative symbol, the at least one replacement target symbol that was drawn, after at least one of the plurality of symbols is arranged; and performing a win determination based at least in part on an arrangement of symbols which are in at least a part of the predefined area, after the at least one replacement target symbol that was drawn is replaced by the at least alternative symbol.

In still other aspects, a non-transitory computer readable medium that stores a computer program to be executed by a computer to perform a gaming method that may further include, but is not limited to, arranging a plurality of symbols in a predefined area; drawing at least one replacement target symbol to be replaced; replacing, with at least alternative symbol, the at least one replacement target symbol that was drawn, after at least one of the plurality of symbols is arranged; and performing a win determination based at least in part on an arrangement of symbols which are in at least a part of the predefined area, after the at least one replacement target symbol that was drawn is replaced by the at least alternative symbol Some aspects of the embodiments are to provide a game apparatus and a program enabling symbol replacement having unexpectedness or variety.

Other aspects of the embodiments are to provide a game apparatus and a program enabling the operating effect of the embodiments to be described later.

Still other aspects of the embodiments are to provide a program to cause a computer to function as the above-noted game apparatus.

(First Embodiment)

FIG. 1 is a block diagram showing an example of the general configuration of a game apparatus 1 according to an embodiment of the present invention. The illustrated game apparatus 1 has a start button 11, a bet button 12, and a payout request button 13 as input devices to accept operations from a player, a display device 14, a medal management device 15 that manages the insertion and payout of medals as the playing medium, and a control device 16 that controls the game. The start button 11, in response to being pressed by the player, outputs a game start signal to the control device 16. Each time it is pressed by the player, the bet button 12 outputs a bet signal to the control device 16. The payout request button 13, in response to being pressed by the player, outputs a payout request signal to the control device 16. The display device 14 is constituted so as to include a liquid crystal display panel, an organic EL (electroluminescence) display, or the like, and displays a game screen or the like in response to an image signal output from control device 16. The medal management device 15 outputs a medal insertion signal to the control device 16 each time insertion of a medal by the player is detected, and pays out medals to the player in response to a medal payout signal from the control device 16.

The control device 16 is constituted as a computer device that includes a micro-processing unit (MPU) 17 and a main storage device 18, such as a ROM (read-only memory) or RAM (read-only memory) required for the operation of the MPU 17. The control device 16 has connected thereto an external storage device 19 that uses, for example, a magnetic disk storage device. The external storage device 19 stores a program and data for controlling a game, the program and data, in accordance with instructions from the MPU 17, being read into the main storage device 18 from the external storage device 19 as required. In the control device 16, in accordance with the program read into the main storage device 18, the MPU 17 controls the progress of a game by executing various computational processing and operation processing. As an example of the game apparatus 1 of the present embodiment, the buttons 11 to 13, the display device 14, the medal management device 15, and the control device 16 are built into an enclosure (not shown) to constitute a commercial game apparatus that provides to a player a game of a certain scope in exchange for game value that is symbolized by medals. For example, in a game provided by the game apparatus 1, a win determination is made in accordance with the disposition of a plurality of symbols displaced on a N-row-by-M-column matrix (where N and M are positive integers, such as three rows and three columns), so as to determine the disbursement to the player, in a so-called slot machine game.

(Game Overview)

Figure 2:
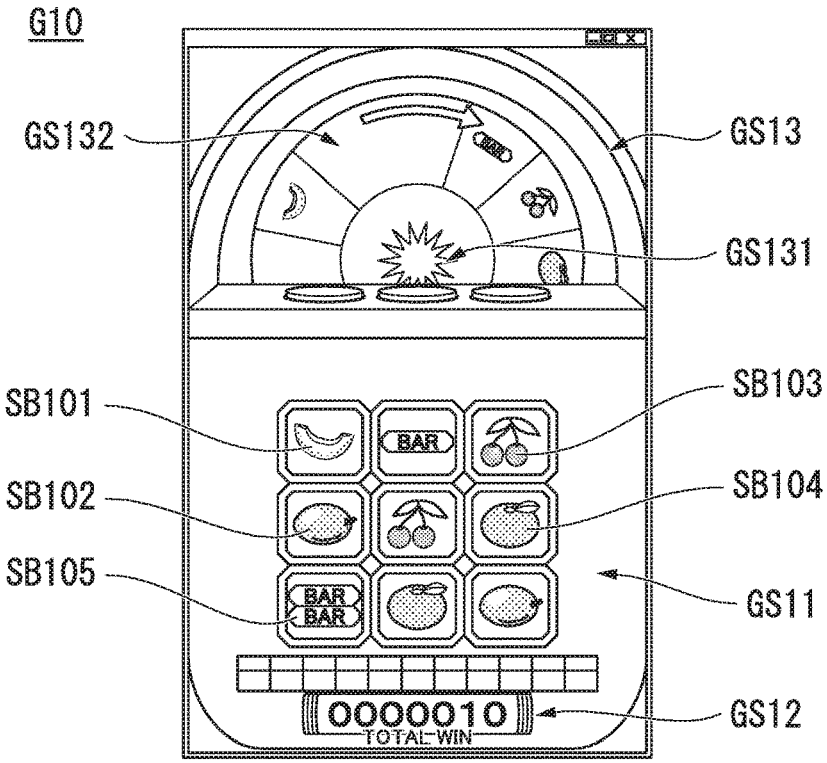
FIG. 2 shows an example of a game screen of a slot machine game according to the first embodiment.

FIG. 2 shows an example of a game screen of a slot machine game according to the present embodiment. In this drawing, the reference symbol G10 indicates the overall game screen area of a game according to the present embodiment, and, in the description to follow, this will be referred to as the game screen G10, regardless of the content displayed thereon. The game screen G10 displays the slot machine screen GS11, the number of wins (WIN) screen GS12, and the symbol replacement drawing screen GS13. The slot machine screen GS11 has arranged thereon a plurality of symbols as a prescribed area in which a win determination is made. On the slot machine screen GS11, nine symbols are arranged in a matrix arrangement of three rows and three columns. The symbol types are distinguished by visual elements that can be recognized by the player, such as a picture, design, numeral, color, and shape. For example, the symbols arranged on the slot machine screen GS11 are, for example, a symbol SB101 that has a melon design, a symbol SB102 that has a plum design, a symbol SB103 that has a cherry design, a symbol SB104 that has an orange design, and a symbol SB105 that has a BAR design, so that they are displayed with various pictures, designs, numerals, and shapes as information for distinguishing the symbol types. Each time nine symbols are arranged on the slot machine screen GS11, a win determination is made. In the following, a symbol with, for example, an "ABC" design (picture, numeral, shape, or the like) will also be referred to as simply as an "ABC" symbol.

The slot machine screen GS11 has three lines in the vertical direction, three lines in the horizontal direction, and two lines in the diagonal direction (direction between diagonally opposing corners of the slot machine screen GS11) that are used as the determination criteria (hereinafter, a winning condition) when performing a win determination. For example, the number of winning lines is set as these eight lines, regardless of the number of medals bet by the player. If all three of the symbols arranged on any winning line are the same type, a win is determined to have occurred, and the player is granted a disbursement. That is, the player is granted a disbursement if all three symbols of the same type are in one direction (continuously) with no symbol of a different type among them.

The number of wins (WIN) screen GS12 displays the number of medals to be disbursed to the player. Although it is omitted from the drawing, there are on the game screen G10, for example, displays of the number of medals bet by the player (bet medal count), the number of medals to be paid out to the player (pay-out medal count), and the number of medals that have been inserted and can be bet by the player (credit medal count).

In the slot machine game according to the present embodiment, replacement of symbols arranged on the slot machine screen GS11 is done. The symbol replacement drawing screen GS13 displays a presentation regarding a drawing when replacing any one symbol arranged on the slot machine screen GS11 with another symbol. Specifically, the display provides a presentation regarding a drawing of a symbol of the symbols arranged on the slot machine screen GS11 that is to be made the replacement target (hereinafter also referred to as a "replacement target symbol") and a drawing of a symbol with which the symbol drawn as the replacement target symbol is to be replaced (hereinafter also referred to as an "alternative symbol"). An alternative symbol drawing presentation GS131 within the symbol replacement drawing screen GS13 displays a presentation regarding the alternative symbol drawing. A replacement target symbol drawing presentation GS132 in the symbol replacement drawing screen GS13 displays a presentation regarding the replacement target symbol drawing. For example, the alternative symbol is first drawn, after which the drawing is made for the replacement target symbol.

In the alternative symbol drawing presentation GS131, as a presentation during the drawing, various symbols are successively displayed as alternative symbol candidates, and the drawing results presentation is the display of only the drawn alternative symbol. In the replacement target symbol drawing presentation GS132, as a presentation during the drawing, various symbols that are to be the replacement target symbol candidates are displayed rotating clockwise like a roulette wheel over the upper half of the periphery, with the alternative symbol drawing presentation GS131 at the center. In the replacement target symbol drawing presentation GS132, as a presentation of the drawing results, the alternative symbol drawn from among the replacement target symbols that rotate clockwise is displayed stopped at the 12-o'clock position.

Figure 3:
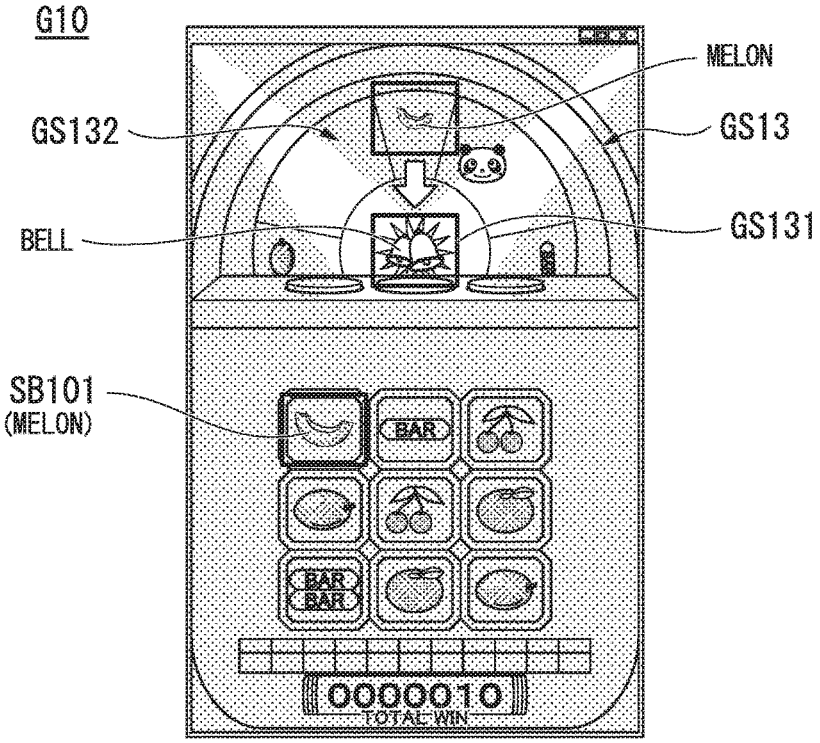
FIG. 3 shows an example of a game screen presenting a display of a drawing for symbol replacement.

FIG. 3 is an example of a game screen displaying a presentation of the symbol replacement drawing results. In the illustrated game screen G10, the symbol replacement drawing screen G13 shows that a bell was drawn as the alternative symbol and that the melon was drawing as the replacement target symbol. In the case of this drawing result, of the symbols arranged on the slot machine screen GS11, the bell symbol is arranged in place of the melon symbol SB101. That is, the melon symbol SB101 arranged on the slot machine screen GS11 is replaced by a bell symbol.

The replacement of symbols arranged on the slot machine screen GS11 may be performed based on the appearance of a specific symbol on the slot machine screen GS11, may be performed based on a prescribed amount of time elapsing from the start of the game, or based on the condition of disposition of symbols arranged on the slot machine screen GS11, or the number of medals to be disbursed to the player. When the symbol replacement is done, because a win determination is made before and after, the probability of satisfying the win condition increases, and the opportunity for the player to obtain a disbursement can be increased.

(Functional Configuration of Processing Executed by the MPU) Next, the functional configuration of the MPU 17 as a game controller executing game processing based on a program for controlling a game will be described.

Figure 4:
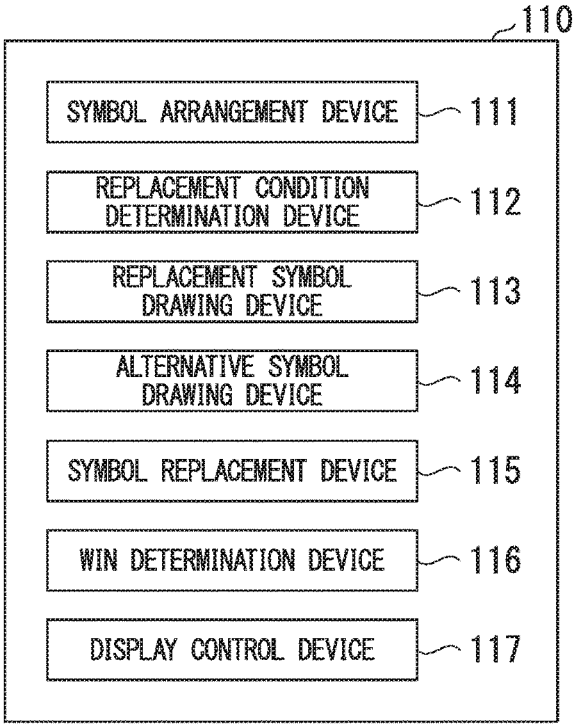
FIG. 4 shows an example of the functional configuration of a game controller according of the first embodiment.

FIG. 4 shows an example of the functional configuration of the game controller 110 according to the present embodiment. The game controller 110 illustrated has a symbol arrangement device 111, a replacement condition determination device 112, a replacement symbol drawing device 113, an alternative symbol drawing device 114, a symbol replacement device 115, a win determination device 116, and a display control device 117.

The symbol arrangement device 111 arranges a plurality of symbols on the slot machine screen GS11. For example, the symbol arrangement device 111 references symbol data stored in the main storage device 18 and selects the type and dispositions of symbols to be caused to appear on the slot machine screen GS11.

FIG. 5 shows an example of symbol data. Symbol data is, in association with each other, the type of symbols that can be arranged on the slot machine screen GS11, the value thereof, and the probability of them appearing. The symbol types include plum, orange, cherry, melon, bell, BAR 1, BAR 2, BAR 3, Blue 7, Red 7, and the like. The symbol types are not restricted to the above-noted types, and various types of symbols can be used. For example, symbols to which special functions are set may be used. The value is set for each type of symbol beforehand. For example, the higher the value of a symbol, the higher is set the disbursement in the case in which the win condition is satisfied. The probability of appearance indicates the probability of appearing (being arranged) on the slot machine screen GS11. For example, the higher is the value of a symbol, the lower is set its probably of appearing.

The replacement condition determination device 112 determines whether or not a replacement condition for replacing at least some of the plurality of symbols arranged on the slot machine screen GS11 with another symbol is satisfied. For example, a determination is made as to whether or not a replacement condition based on symbols arranged in at least part of the slot machine screen GS11 is satisfied. Specifically, the replacement condition determination device 112 may determine whether or not a replacement condition is satisfied, based on the appearance of a specific symbol (for example, a symbol that sets symbol replacement to on) on the slot machine screen GS11, or may determine whether or not the replacement condition is satisfied, based on the amount of time that has elapsed from the start of the game. The replacement condition determination device 112 may determine whether or not the replacement condition is satisfied, based on the disposition state of symbols arranged on the slot machine screen GS11 or on the number of medals to be disbursed to the player. If the determination is that the replacement condition is satisfied, the replacement condition determination device 112 sets a flag indicating whether or not to perform symbol replacement (hereinafter "replacement flag") to on. The replacement flag is set to off at the start of the game.

After the replacement flag is set to on, if the condition for ending the replacement is satisfied, the replacement condition determination device 112 changes the replacement flag from on to off. The replacement ending condition may be the appearance of a specific symbol on the slot machine screen GS11 (for example, a symbol that sets the replacement flag off), may be the elapse of a prescribed amount of time after the replacement flag is set to on, and may be the end of a game in which the replacement flag was set to on.

If the replacement condition determination device 112 determines that the replacement condition is satisfied (if the replacement flag is on), the replacement symbol drawing device 113 draws a replacement target symbol that is the target for replacement.

For example, the replacement symbol drawing device 113, from a plurality of types of symbols, draws the type of replacement target symbol to be replaced. FIG. 6 shows an example of settings of the drawing probabilities when drawing a lottery of the type of replacement target symbol. In the example illustrated, the symbols that can be replacement target symbols are the three types of plum, orange, and cherry. For example, if one type of replacement target symbol is drawn from the three types of symbols, the probability of drawing selecting the plum symbol is a %, the probably of the drawing selecting the orange symbol is b %, and the probability of the drawing selecting the cherry symbol is c %. The probabilities a %, b %, and c % can be set arbitrarily, for example, so that their total is 100%, may be set to mutually different probabilities, and may be set so that some or all thereof are the same probability. Each of the probabilities a %, b %, and c % may be set based on the corresponding probability of appearance or value.

In the case of two replacement target symbols being drawn from among three types of symbols, the probability of the draw selecting the plum and orange symbols is d %, the probability of the draw selecting the plum and cherry symbols is e %, and the probability of the draw selecting the orange and cherry symbols is f %. In this case, the probabilities d %, e %, and f %, similar to the case, for example, of drawing one type of replacement target symbol and the like, can be arbitrarily set. If three replacement target symbols are to be drawn from the three types of symbols, the only symbols that are selected is the combination of the plum, orange, and cherry symbols, the drawing probability thereof being 100%.

The replacement symbol drawing device 113 may draw the number of types of replacement target symbols, and draw that number of types of symbols from the plurality of types of symbols. FIG. 7 shows an example of settings of the drawing probabilities when drawing the number of types of replacement target symbols. The example illustrated is one in which, from three types of replacement target symbols, replacement target symbols of the number of types selected by a drawing are drawn. In this case, the probability of the number of types of replacement target symbols being 0% (Lose) is a %, the probably of one type is b %, the probably of two types is c %, and the probably of three types is d %. The probabilities a %, b %, c %, and d % can be arbitrarily set. For example, by setting these probabilities so that a %>b %>c %>d %, the greater is the number of replacement target symbol types, the lower is the drawing probability, enabling the imparting of a special feeling to a player. After the number of types of replacement target symbols is drawn, the replacement target symbols of the drawn number of types are drawn in accordance with, for example, the settings shown in FIG. 6.

The replacement symbol drawing device 113 may, of the symbols arranged on the slot machine screen GS11, select the symbols to be made the replacement target symbols. The replacement symbol drawing device 113 may, of the slot machine screen GS11, draw the positions of the symbols to be made replacement target symbols, in which case, the size of the drawn area may be a size in which one symbol is included, or may be size in which a plurality of symbols are included. The replacement symbol drawing device 113, of the slot machine screen GS11, may draw the number of positions of symbols to be made replacement target symbol, and draw that number of positions.

Figures 8, 9:
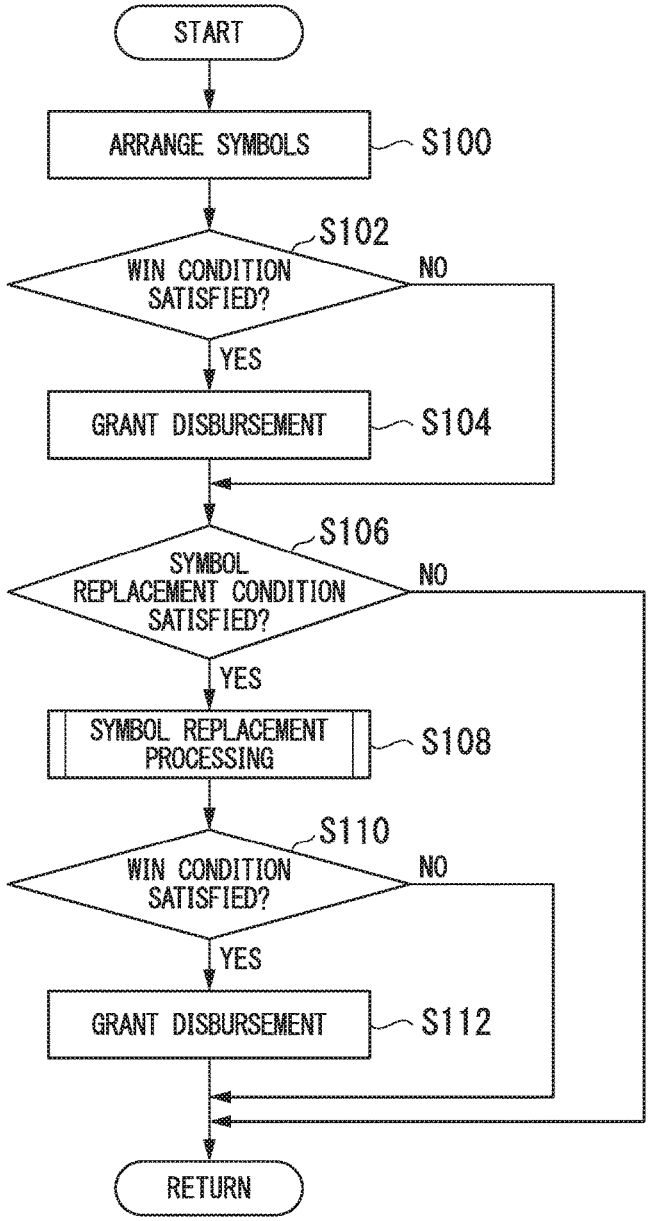
FIG. 8 shows an example of settings of the drawing probabilities when a drawing is made for the alternative symbol types.
FIG. 9 is a flowchart showing an example of game processing according to the first embodiment.

The alternative symbol drawing device 114 draws the symbol (alternative symbol) that is to replace a replacement target symbol. For example, the alternative symbol drawing device 114 draws the type of alternative symbol to be arranged in place of the replacement target symbol. FIG. 8 show an example of settings of the drawing probabilities when a drawing is done of the type of alternative symbol. In the example shown, the symbols that can be the alternative symbol are Red 7, Blue 7 BAR 3, BAR 2, BAR 1, bell, melon, and plum. In this case, the probabilities of Red 7, Blue 7 BAR 3, BAR 2, BAR 1, bell, melon, and plum being drawn are set to a %, b %, c %, d %, e %, f %, g %, and h %, respectively. These probabilities can be arbitrarily set. For example, the probabilities can be set so that the higher is the value of a symbol, the lower is the probability that is set. For example, the alternative symbol drawing device 114, as the type of alternative symbols, may draw types of symbols having a value that is the same or higher than that of the replacement target symbols.

The alternative symbol drawing device 114, as the type of replacement target symbols, may draw a number of types of alternative symbols that is the same or smaller than the type of replacement target symbols. For example, if there are two types of replacement target symbols, the alternative symbol drawing device 114 may draw two types of alternative symbols or one type of alternative symbol.

After at least some of a plurality of symbols are arranged by the symbol arrangement device 111, the symbol replacement device 115 replaces the replacement target symbols selected by the replacement symbol drawing device 113 with alternative symbols.

The win determination device 116 performs a win determination by determining whether or not a win condition is satisfied, based on the disposition of a plurality of symbols arranged on the slot machine screen GS11. For example, the win determination device 116, in accordance with the disposition of a plurality of symbols on the slot machine screen GS11 by the symbol arrangement device 111, performs a win determination based on the disposition of a symbols on at least a part of the slot machine screen GS11. After symbol replacement by the symbol replacement device 115, the win determination device 116 performs a win determination, based on the disposition of symbols on at least a part of the slot machine screen GS11. That is, the win determination device 116 performs a win determination before both before and after the symbol replacement by the symbol replacement device 115. The win determination device 116 may perform the win determination at one of before and after the symbol replacement by the symbol replacement device 115. The win determination device 116, upon determining that the win condition is satisfied, grants a disbursement to a player.

The display control device 117 generates image data of a game screen to be displayed on the display device 14 and outputs to the display device 14 an image signal, based on the generated image data, thereby causing the display device 14 to display the game screen. By doing this, the display control device 117 causes the game screen to be displayed on the display device 14. For example, the display control device 117 causes the display of the slot machine screen GS11 in which a plurality of symbols are arranged by the symbol arrangement device 111. The display control device 117 causes display on the display device 14 of a presentation (alternative symbol drawing presentation GS131) regarding the drawing of alternative symbols by the alternative symbol drawing device 114 and a presentation (replacement target symbol drawing presentation GS132) regarding the drawing of a replacement target symbol by the replacement symbol drawing device 113.

For example, the display control device 117, after making a display of one of the result of drawing by the alternative symbol drawing device 114 and the result of drawing by the replacement symbol drawing device 113, displays the result of the other drawing. As an example, the display control device 117, after displaying the result of the drawing by the alternative symbol drawing device 114, displays the result of the drawing by the replacement symbol drawing device 113. Alternatively, after displaying the result of the drawing by the replacement symbol drawing device 113, the display control device 117 may display the result of the alternative symbol drawing device 114. In this case, there need not be a correlation between the sequence of displaying the above-noted drawing results and the sequence of processing by the alternative symbol drawing device 114 and the replacement symbol drawing device 113. For example, the processing for the drawing by the alternative symbol drawing device 114 and the drawing by the replacement symbol drawing device 113 may be performed simultaneously, or one may be performed before the other.

(Game Processing Operation)

Next, the operation of game processing according to the present embodiment will be described.

FIG. 9 is a flowchart showing an example of the game processing according to the present embodiment.

First, when a player presses the start button 11, the game controller 110 acquires a game start signal and arranges a plurality of symbols on the slot machine screen GS11 (step S100).

Next, the game controller 110, based on the disposition of the symbols arranged on at least a part of the slot machine screen GS11, determines whether or not the win condition is satisfied (step S102). If the game controller 110 determines that the win condition is satisfied (YES), it grants a disbursement to the player (step S104) and proceeds to the processing of step S106. If, however, the game controller 110 determines that the win condition is not satisfied (NO), it proceeds to the processing of step S106 without granting a disbursement to the player.

At step S106, the game controller 110 determines whether or not the symbol replacement condition is satisfied. If the game controller 110 determines that the replacement condition is satisfied (YES), it executes processing to perform symbol replacement (symbol replacement processing) (step S108). For example, the game controller 110 draws the type of replacement target symbol and the type of the alternative symbol to replace the replacement target symbol and, based on the drawing results, replaces the replacement target symbol with the alternative symbol. If, however, the game controller determines that the replacement condition is not satisfied (NO), it returns to the processing of step S100 without executing symbol replacement.

Next, the game controller 110, based on the disposition of a plurality of symbols after the symbol replacement processing, determines whether or not the win condition is satisfied (step S110). If the game controller 110 determines that the win condition is satisfied (YES), it grants a disbursement to the player (step S112) and returns to the processing of step S100. If, however, the game controller 117 determines that the win condition is not satisfied (NO), it returns to the processing of step S100 without granting a disbursement to the player.

(Symbol Replacement Processing)

Figure 10:
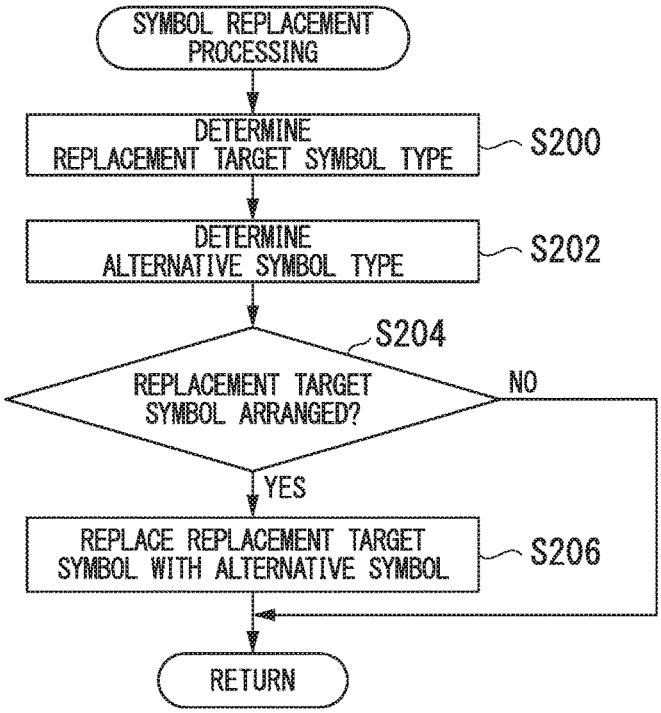
FIG. 10 is a flowchart showing a first example of symbol replacement processing.

Next, referring to FIG. 10, the operation of the specific processing performed in the symbol replacement (step S108 in FIG. 9) will be described. FIG. 10 is a flowchart showing a first example of the symbol replacement processing.

First the game controller 110 draws the type of replacement target symbol to determine the type of the replacement target symbol (step S200). The game controller 110 makes a drawing of the type of alternative symbol to determine the alternative symbol type (step S202).

Next, the game controller 110 determines whether or not the determined type of replacement target symbol is arranged on the slot machine screen GS11 (step S204). If the game controller 110 determines that the replacement target symbol is arranged on the slot machine screen GS11 (YES), it replaces the replacement target symbol with the alternative symbol (step S206). If, however, the game controller 110 determines that the replacement target symbol is not arranged on the slot machine screen GS11 (NO), it does not perform symbol replacement. The game controller 110 then ends the symbol replacement processing and returns to the processing of FIG. 9.

(Other Examples of Symbol Replacement Processing)

Next, referring to FIG. 11 to FIG. 15, the operation of other examples of symbol replacement processing will be described.

Figure 11:
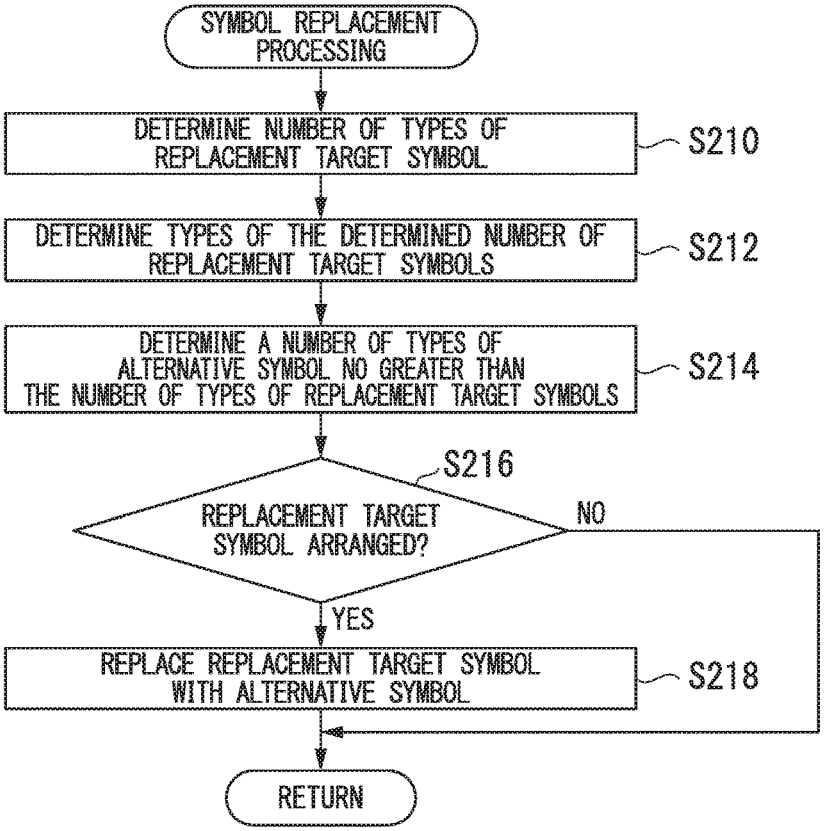
FIG. 11 is a flowchart showing a second example of symbol replacement processing.

FIG. 11 is a flowchart showing a second example of symbol replacement processing. In the example illustrated, the number of types of symbols to be made replacement target symbols is also drawn. First, the game controller 110 draws to determine the number of types of replacement target symbols (step S210). Next, the game controller 110 draws the determined number of symbol types (step S212). The game controller 110 draws to determine a number of types of replacement target symbols that is no greater than the determined number of types of replacement target symbols (step S214).

Next, the game controller 110 determines whether or not replacement target symbols of the determined type are arranged on the slot machine screen GS11 (step S216). If the game controller 110 determines that the replacement target symbols are arranged on the slot machine screen GS11 (YES), it replaces the replacement target symbol with the alternative symbol (step S218). If, however, the game controller 110 determines that the replacement target symbols are not arranged on the slot machine screen GS11 (NO), it does not perform symbol replacement. The game controller 110 then ends the symbol replacement processing and returns to the processing of FIG. 9.

Figure 12:
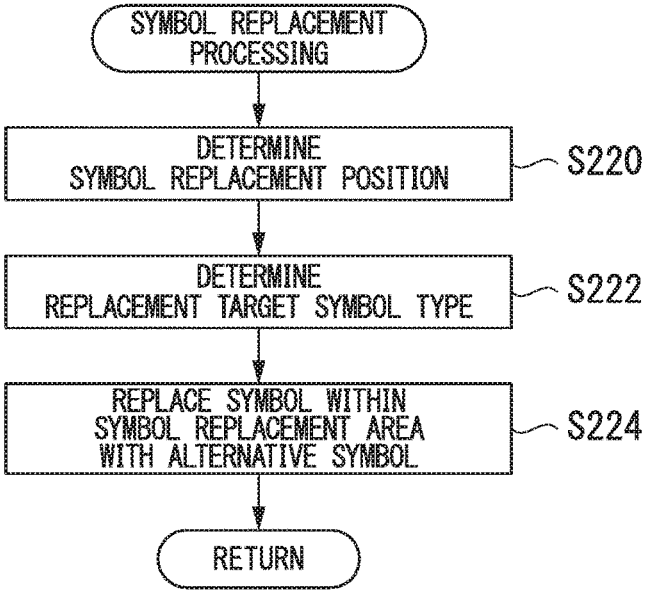
FIG. 12 is a flowchart showing a third example of symbol replacement processing.

FIG. 12 is a flowchart that showing a third example of the symbol replacement processing. In the example illustrated, the position on the slot machine screen GS11 of the symbol to be the replacement target symbol is drawn. First, the game controller 110 draws to determine the position (replacement target position) on the slot machine screen GS11 of the symbol to be the replacement target symbol (step S220). The game controller 110 draws to determine the type of the replacement target symbol (step S222). If the game controller 110 has determined a plurality of replacement target areas, it draws to determine the replacement target symbol type for each of the replacement target areas. The game controller 110 replaces a symbol in the replacement target area with an alternative symbol (step S224).

Figure 13:
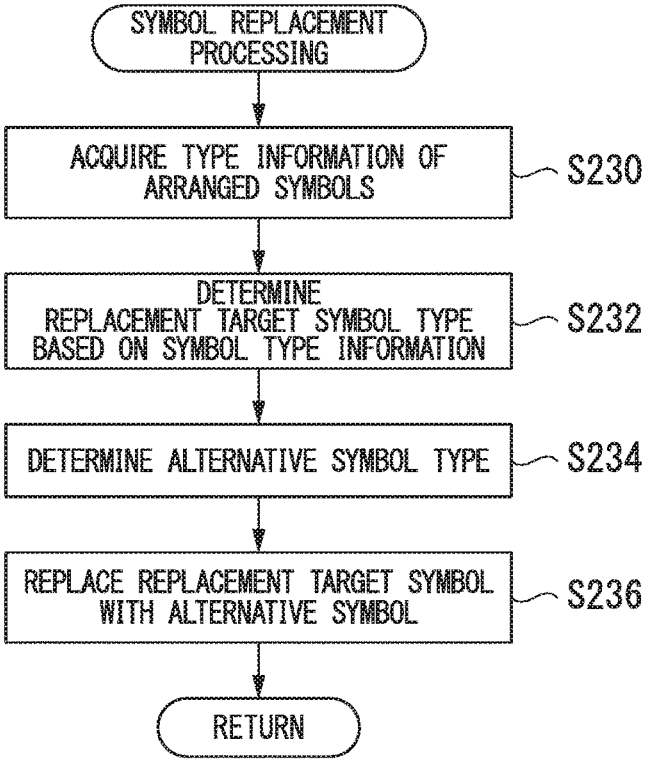
FIG. 13 is a flowchart showing a fourth example of symbol replacement processing.

FIG. 13 is a flowchart showing a fourth example of the symbol replacement processing. In the example illustrated, the alternative symbol type is drawn based on the type of symbol arranged on the slot machine screen GS11. First, the game controller 110 acquires type information regarding the types of symbols arranged on the slot machine screen GS11 (step S230). Next, the game controller 110 determines the type of alternative symbol by a drawing, based on the acquired type information (step S232). For example, the game controller 110, based in the acquired type information, draws to determine the type of replacement target symbol from among the types of symbols arranged on the slot machine screen GS11. That is, the game controller 110 does not select as the replacement target a symbol type that is not arranged on the slot machine screen GS11. The game controller 110 draws the type of alternative symbol to determine the type of the alternative symbol (step S234). The game controller 110 then replaces the replacement target symbol with the alternative symbol (step S236).

Figure 14:
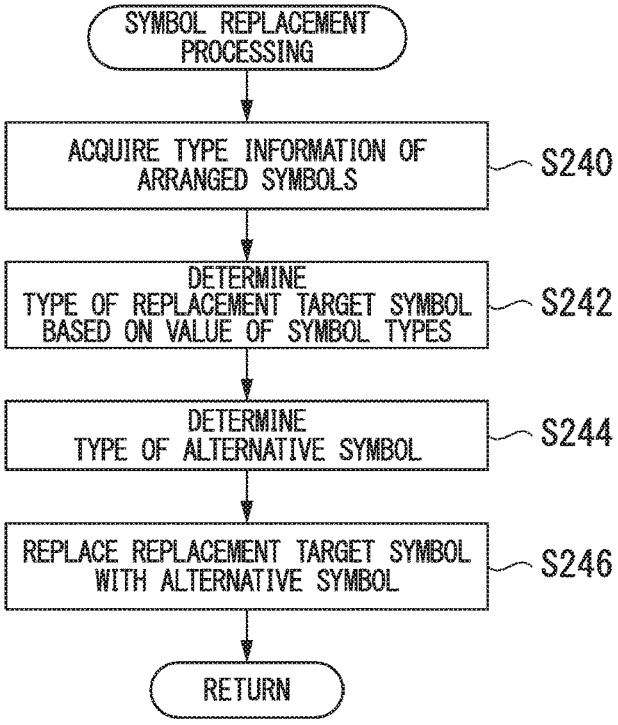
FIG. 14 is a flowchart showing a fifth example of symbol replacement processing.

FIG. 14 is a flowchart showing a fifth example of the replacement processing. In the example illustrated, the type of the replacement target symbol is determined based on the values of the types of symbols arranged on the slot machine screen GS11. First, the game controller 110 acquires type information of symbols arranged on the slot machine screen GS11 (step S240). Next, the game controller 110 references the acquired type information and determines the alternative symbol type based on the values of the types of symbols arranged on the slot machine screen GS11 (step S242). For example, the game controller 110 determines the type of the replacement target symbol based on the value ranking of the types of symbols arranged on the slot machine screen GS11. Specifically, the game controller 110, for example, determines as the replacement target symbol as symbol type that, of the types of symbols arranged on the slot machine screen GS11, has the lowest value. The game controller 110 then draws to determine the type of the alternative symbol (step S244). The game controller 110 then replaces the replacement target symbol with the alternative symbol (step S246).

Figure 15:
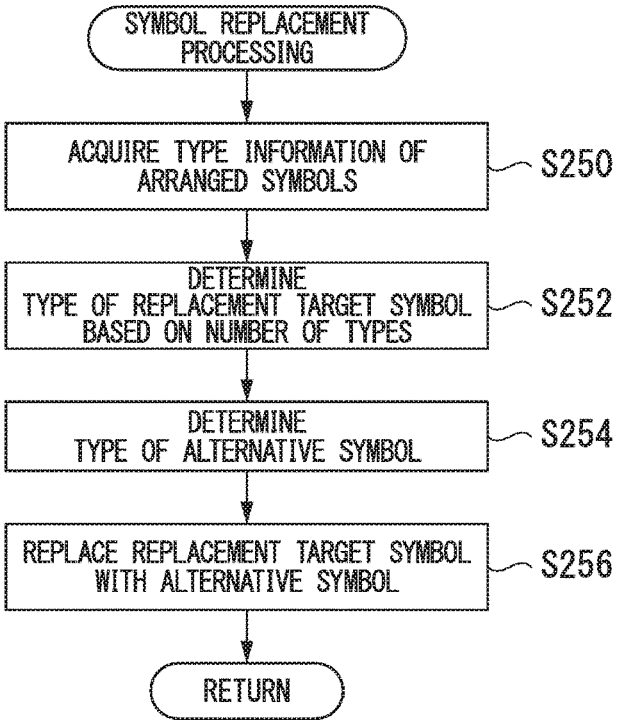
FIG. 15 is a flowchart showing a sixth example of symbol replacement processing.

FIG. 15 is a flowchart showing a sixth example of the symbol replacement processing. In the example illustrated, the replacement target symbol type is determined based on the number of the types of symbols arranged on the slot machine screen GS11. First, the game controller 110 acquires type information of the symbols arranged on the slot machine screen GS11 (step S250). Next, the game controller 110 determines the type of the replacement target symbol based on the number of types of symbols arranged on the slot machine screen GS11 (step S252). For example, the game controller 110 references the acquired type information and determines as the replacement target symbol a symbol of the type that is most numerous of the symbols arranged on the slot machine screen GS11 or a symbol of the type that is the least numerous therein. The game controller 110 may determine a plurality of types of symbols as replacement target symbols, based on the number of types of symbols arranged on the slot machine screen GS11. The game controller 110 draws to determine the alternative symbol type (step S254). The game controller 110 then replaces the replacement target symbol with the alternative symbol (step S256).

(Symbol Replacement Determination Processing)

Figure 16:
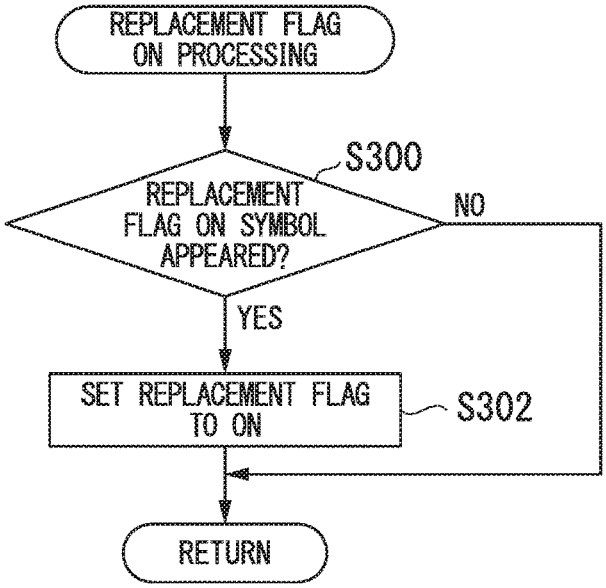
FIG. 16 is a flowchart showing an example of symbol replacement flag on processing according to the first embodiment.

Next, referring to FIG. 16 and FIG. 17, the operation of symbol replacement determination processing will be described. FIG. 16 is a flowchart showing an example of the symbol replacement flag on processing according to the present embodiment. In this case, the operation of on processing of the replacement flag will be described for the case in which the replacement condition is determined to be satisfied based on the appearance on the slot machine screen GS11 of a specific symbol (for example, a symbol that turns symbol replacement to on).

The game controller 110 determines whether or not a symbol that turns symbol replacement on has appeared on the slot machine screen GS11 (step S300). If the game controller 110 determines that the symbol that turns symbol replacement on has appeared (YES), it sets the replacement flag to on (step S302). If, however, the game controller 110 determines that a symbol that turns symbol replacement to on has not appeared (NO), it returns to the processing of step S300 without changing the replacement flag.

Figure 17:
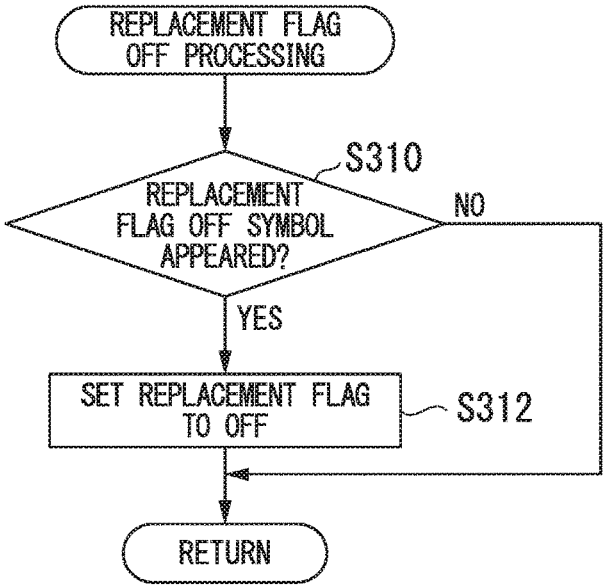
FIG. 17 is a flowchart showing an example of symbol replacement flag off processing according to the first embodiment.

FIG. 17 is a flowchart showing an example of symbol replacement flag off processing according to the present embodiment. In this case, the operation of off processing of the replacement flag will be described for the case in which the replacement condition is determined to be satisfied based on the appearance on the slot machine screen GS11 of a specific symbol (for example, a symbol that turns symbol replacement to off).

The game controller 110 determines whether or not a symbol that turns symbol replacement off has appeared on the slot machine screen GS11 (step S310). If the game controller 110 determines that a symbol that turns symbol replacement off has appeared (YES), it sets the replacement flag to off (step S312). If, however, the game controller 110 determines that a symbol that turns symbol replacement off has not appeared (NO) it returns to the processing of step S310 without changing the replacement flag.

(Summary of the First Embodiment)

As described above, the game apparatus 1 according to the present embodiment has a symbol arrangement device 111, a replacement symbol drawing device 113, a symbol replacement device 115, and a win determination device 116. The symbol arrangement device 111 arranges a plurality of symbols on the slot machine screen GS11 (an example of a prescribed area). The replacement symbol drawing device 113 draws a symbol (replacement target symbol) that is made the target for replacement. The symbol replacement device 115, after at least some symbols of the plurality of symbols are arranged by the symbol arrangement device 111, replaces the symbols (replacement target symbols) that are selected by the replacement symbol drawing device 113 as replacement target symbols by other symbols (alternative symbols). The win determination device 116, after the symbol replacement is made by the symbol replacement device 115, makes a win determination based on the disposition of symbols in at least a part of the slot machine screen GS11.

By doing this, because the alternative symbols can be randomly changed each time of symbol replacement, the game apparatus 1 can impart unexpectedness or variety regarding symbol replacement.

For example, the replacement symbol drawing device 113, from a plurality of types of symbols, draws the type of symbol (replacement target symbol) to be the target of replacement. By doing this, the game apparatus 1, because the type of the replacement target symbol is randomly changed at the time of symbol replacement, can impart unexpectedness and variety to the symbol replacement. As the drawing result, the replacement target symbol may be always selected, or there may be cases in which a replacement target symbol is not selected (a "lose")

The replacement symbol drawing device 113 may draw the number of types of symbols to be replacement targets (replacement target symbols) and may draw from the plurality of types of symbols that number of symbol types. By doing this, the game apparatus 1, because it randomly changes the number of types of replacement target symbol when replacing a symbol, can impart variety regarding the symbol replacement.

The replacement symbol drawing device 113, of the slot machine screen GS11 (an example of a prescribed region), may draw a position of a symbol (replacement target symbol) to be the target for replacement. By doing this, the game apparatus 1, because it randomly changes the replacement target symbol position when a symbol replacement is done, can impart unexpectedness or variety regarding symbol replacement.

The replacement symbol drawing device 113, of the slot machine screen GS11 (an example of a prescribed area), may draw the number of positions of a symbol (replacement target symbol) and draw that number of positions. By doing this, the game apparatus 1, because it randomly changes the position of the replacement target symbol and also randomly changes the number of positions thereof when symbol replacement is done, can impart variety regarding the symbols.

The game apparatus 1 also has an alternative symbol drawing device 114 that draws the other symbol (alternative symbol) to replace the symbol (replacement target symbol) that is the target of replacement. By doing this, the game apparatus 1, because it randomly changes not only the symbol that is the target for replacement (replacement target symbol) but also the alternative symbol to replace the replacement target symbol, can impart unexpectedness or variety regarding symbol replacement.

For example, the alternative symbol drawing device 114 draws the type of the other symbol (alternative symbol) to replace the symbol that is the target for replacement (replacement target symbol).

By doing this, the game apparatus 1, because it randomly changes the type of the other symbol (alternative symbol) to replace the replacement target symbol, can impart unexpectedness or variety regarding symbol replacement.

The alternative symbol drawing device 114 may select as the above-noted other symbol (alternative symbol) a number of symbols (alternative symbols) that is the same as or fewer than the number of symbols that are the targets of replacement (replacement target symbols). By doing this, the game apparatus 1 can, because it replaces the plurality of types of symbols included on the slot machine screen GS11 with symbols of a number of types that is fewer than that number, make it easier for a win to occur and impart variety to the game progression. Also, the game apparatus 1 may draw a plurality of positions of symbols that are replacement target symbols and replace the symbols arranged at the plurality of positions with a single type of symbol. In this case as well, the game apparatus 1, because it replaces symbols in a plurality of regions with a single type of symbol, can make it easier for a win to occur and impart variety to the game progression.

The alternative symbol drawing device 114, as the above-noted other symbol type, may draw a type of symbol (alternative symbol) that has the same value as or a greater value than the symbol that is the target for replacement (replacement target symbol). By doing this, the game apparatus 1, because, for example, it replaces the symbol that is the target for replacement with a symbol that has a higher value, can make a win easier to occur, and can impart variety to the game progression.

The game apparatus 1 also has a replacement condition determination device 112. The replacement condition determination device 112 determines whether or not the replacement condition that allows symbol replacement by the symbol replacement device 115 is satisfied. If the replacement condition is satisfied, the replacement symbol drawing device 113 draws the symbol to be the target for replacement (replacement target symbol). By doing this, the game apparatus 1, because it performs symbol replacement only when the replacement condition is satisfied, can impart unexpectedness or variety regarding the game progression.

For example, the replacement condition determination device 112 determines whether or not the replacement condition is satisfied based on symbols arranged on at least a part of the slot machine screen GS11 (an example of a prescribed area). By doing this, the game apparatus 1, because it performs symbol replacement in accordance with the disposition of symbols in the slot machine game, can heighten the interest in the game.

The game apparatus 1 also has a display control device 117 that makes a display of the game screen. For example, the display control device 117 after making a display of one of the result of drawing by the alternative symbol drawing device 114 and the result of drawing by the replacement symbol drawing device 113, displays the result of the other drawing. By doing this, the game apparatus 1, because it displays one drawing result and then displays the other drawing result, can impart a feeling of expectation to the player before the final drawing result is displayed, thereby enabling a heightening of interest in the game.

For example, the display control device 117 may change the display format of symbols, of the symbols arranged on the slot machine screen GS11 (an example of a prescribed area) corresponding to the drawing results in accordance with the results of the drawing by the alternative symbol drawing device 114. In the condition in which the display format of symbols corresponding to the drawing results has been changed, the display control device 117 may, in accordance with the drawing by the replacement symbol drawing device 113, change the format of the display of symbols, of the symbols arranged on the slot machine screen GS11, corresponding to the drawing results. By doing this, the game apparatus 1, because it can make easier for a player to view the progress of the drawing results on the slot machine screen GS11, can impart a feeling of expectation to the player and heighten interest in the game.

(Second Embodiment)

Next, the second embodiment of the present invention will be described.

The based configuration of a game apparatus 1 of the present embodiment is the same as the configuration of the game apparatus 1 shown in FIG. 1. In the following, the game apparatus according to the present embodiment will be referred to as the game apparatus 1A. In the present embodiment, because the game processing differs from that in the first embodiment, the game processing and the function configuration that executes the game processing will be described.

(Game Overview)

First, the overview of the game according to the present embodiment will be described.

Figure 18:
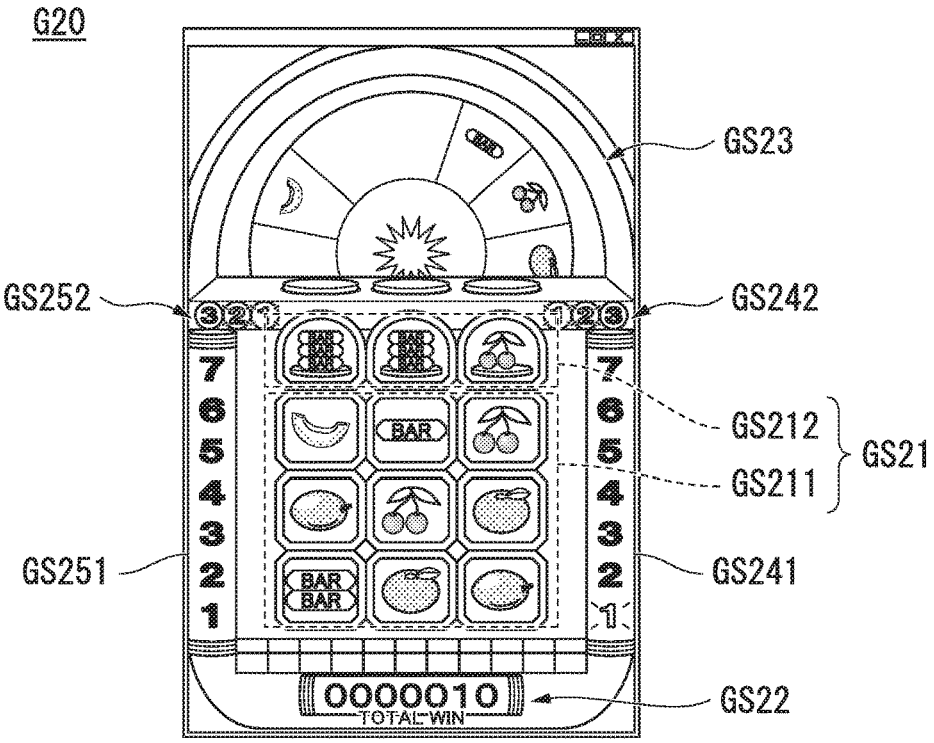
FIG. 18 shows an example of a game screen of a slot machine game according to a second embodiment.

FIG. 18 shows an example of a game screen of a slot machine game according to the present invention. In this drawing, the reference symbol G20 indicates the overall game screen area of a game according to the present embodiment, and, in the description to follow, this will be referred to as the game screen G20, regardless of the content display in the screen. The game screen G20 displays the slot machine screen GS21, the number of wins (WIN) screen GS22, and the symbol replacement drawing screen GS23. The slot machine screen GS21 includes a main area GS211, in which a win determination is performed, and a reserved area GS212, which is a region above the main area GS211 in which a win determination is not performed.

The main area GS211, similar to the slot machine screen GS11 has arranged therein nine symbols in a matrix arrangement of three rows and three columns. The reserved area GS212 has arranged therein three symbols in the horizontal direction. For example, if the player presses the start button, the reels of the reserved area GS212 and the main area GS211 begin to rotate, the reserved area GS212 reels stopping first, to arrange three symbols, followed next by the main area GS211 reels stopping, to arrange nine symbols. If a deletion condition regarding a symbol arranged in the main area GS211 is satisfied, that symbol is deleted. The symbol arranged above the deleted symbol drops into the position in which the deleted symbol had been arranged. In the main area GS211, if there is no symbol above to drop down, by a symbol from the reserved area GS212 dropping down, the symbols in the main area GS211 are replenished. In the case in which a symbol from the reserved area GS212 drops down, a new symbol appears in the reserved area GS212. After a symbol drops from above into a location from which a symbol was deleted, if the deletion condition is satisfied, that symbol is deleted in the same manner, and symbols will be successively deleted until a disposition state occurs in which the deletion condition is not satisfied.

The symbol deletion condition is based on the disposition of symbols in the main area GS211, for example, symbols of the same type being in a specific disposition state. For example, in the main area GS211, three lines in the vertical direction, three lines in the horizontal direction, and two lines in the diagonal direction (direction between diagonally opposing corners of the main area GS211), for a total of eight deletion lines, are set, and if three symbols arranged along any one of the deletion lines are the same type, the determination is made that the deletion condition is satisfied. In the main area GS211, in the case in which three or more neighboring symbols are of the same type are arranged in row, the deletion condition is determined to have been satisfied. These deletion conditions are exemplary. Other arrangements may be made the deletion condition, and the deletion condition may be something other than the disposition condition (for example, the appearance of a specific symbol).

The game screen G20 has displayed thereon a red step gauge GS241 corresponding to the main area GS211 and a blue step gauge GS251 corresponding to the reserved area GS212. The red step gauge GS241 is displayed as an index that determines whether or not the symbol replacement condition is satisfied in the main area GS211. In response to a specific symbol (for example, red step) that has appeared in the reserved area GS212 dropping (moving) into the main area GS211, the steps in the red step gauge GS241 increase. For example, if a Red Step 1 symbol drops into the main area GS211, the red step gauge GS241 increases by one, and if a Red Step 2 symbol moves into the main area GS211, the red step gauge GS241 increases by two.

Figure 19:
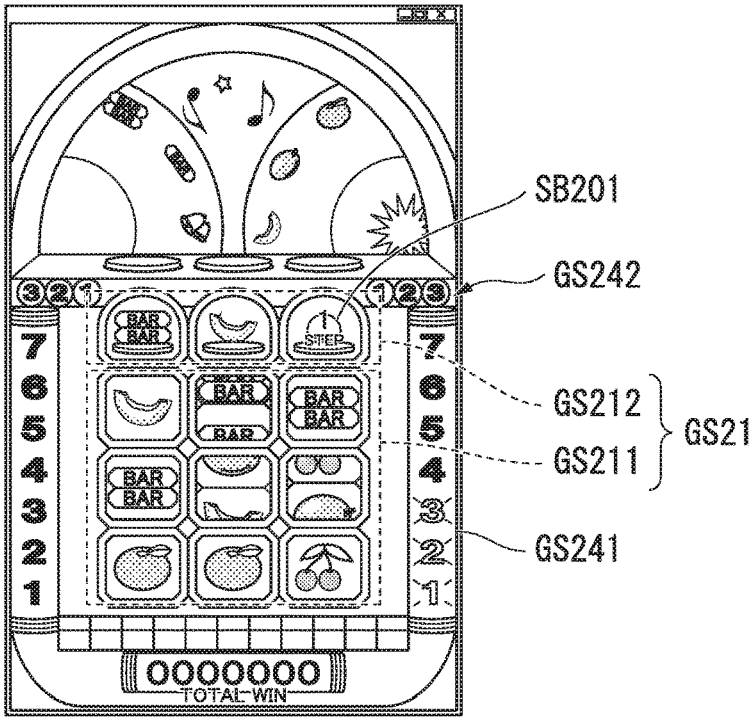
FIG. 19 shows an example of a game screen when a "Red Step 1" symbol appears in the reserved area.
Figure 20:
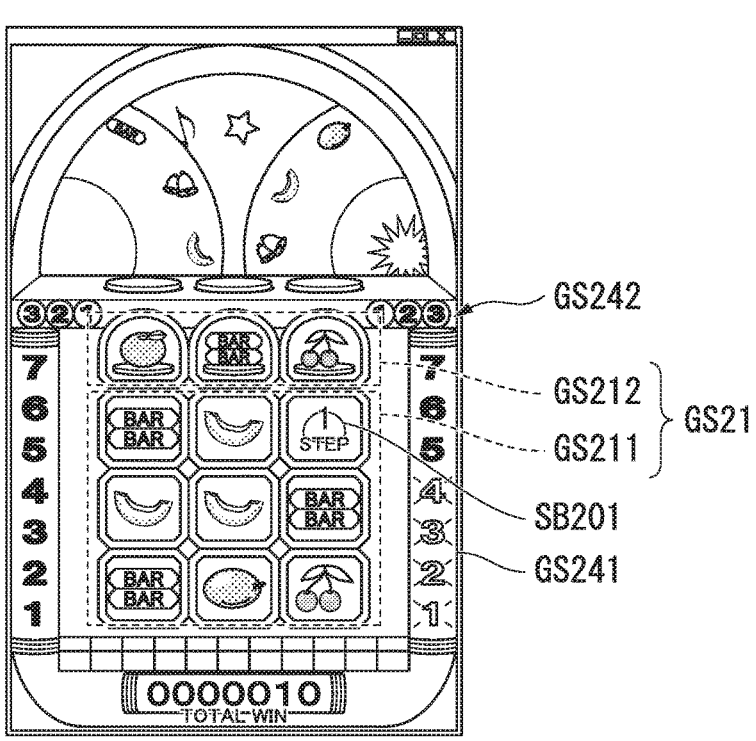
FIG. 20 shows an example of a game screen in which the "Red Step 1" symbol has dropped into the main area.

FIG. 19 shows an example of a game screen when a Red Step 1 symbol appears in the reserved area. In the example illustrated, a Red Step 1 symbol SB201 has appeared in the reserved area GS212. In the red step gauge GS241, 1 to 3 are active displays, and 4 to 7 are inactive displays, indicating that there are three steps. In contrast, FIG. 20 shows an example of a game screen when a Red Step 1 that appeared in the reserved area has dropped into the main area. In the example illustrated, by the Red Step 1 symbol SB201 dropping into the main area GS211, the red step gauge GS241 indicates an increase by one of the number of steps, from 3 to 4.

By Red Step symbols appearing in the reserved area GS212 dropping into the main area GS211 a plurality of times, if the steps in the red step gauge GS241 reach or exceed a prescribed value (for example, seven), the symbol replacement condition in the main area GS211 is satisfied. When the symbol replacement condition is satisfied, the effect of symbol replacement processing being executed in the main area GS211 from the next time a prescribed number of times (for example three times) is activated. The effect gauge GS242 indicates the number of times that symbol replacement will be executed in the main area GS211. For example, if the symbol replacement condition is satisfied, the numbers for three times are displayed as active by the effect gauge, and each time symbol replacement processing is executed, the one of the active times in the effect gauge becomes an inactive display. That is, the effect gauge GS242 indicates the number remaining times of symbol replacement processing. When the symbol replacement processing is executed three times the display for all three times in the effect gauge GS242 become inactive displays, thereby ending the effect of executing symbol replacement processing. When the red step gauge GS241 steps are zero, all of 1 to 7 displays become inactive displays.

The blue step gauge GS251 is displayed as an index that determines whether or not the symbol replacement condition is satisfied in the reserved area GS212. In response to a specific symbol (for example, a Blue Step) that has appeared in the reserved area GS212 dropping (moving) into the main area GS211, the steps in the blue step gauge GS251 increase. For example, if a Blue Step 1 symbol drops into the main area GS211, the blue step gauge GS251 increases by one, and if a Blue Step 2 symbol moves into the main area GS211, the blue step gauge GS251 increases by two. If the steps in the blue step gauge GS251 reach or exceed a prescribed value (for example, 7), the symbol replacement condition in the reserved area GS212 is satisfied, and the effect of symbol replacement processing being executed in the reserved area GS212 from the next time a prescribed number of times (for example three times) is activated. The effect gauge GS252 indicates the number of times (remaining times) that symbol replacement will be executed in reserved area GS212. When symbol replacement processing is executed three times, all the three times displays on the effect gauge GS252 become inactive displays and the effect of executing symbol replacement processing is ended. When the blue step gauge GS251 steps are zero, all of 1 to 7 displays become inactive displays.

Figure 21:
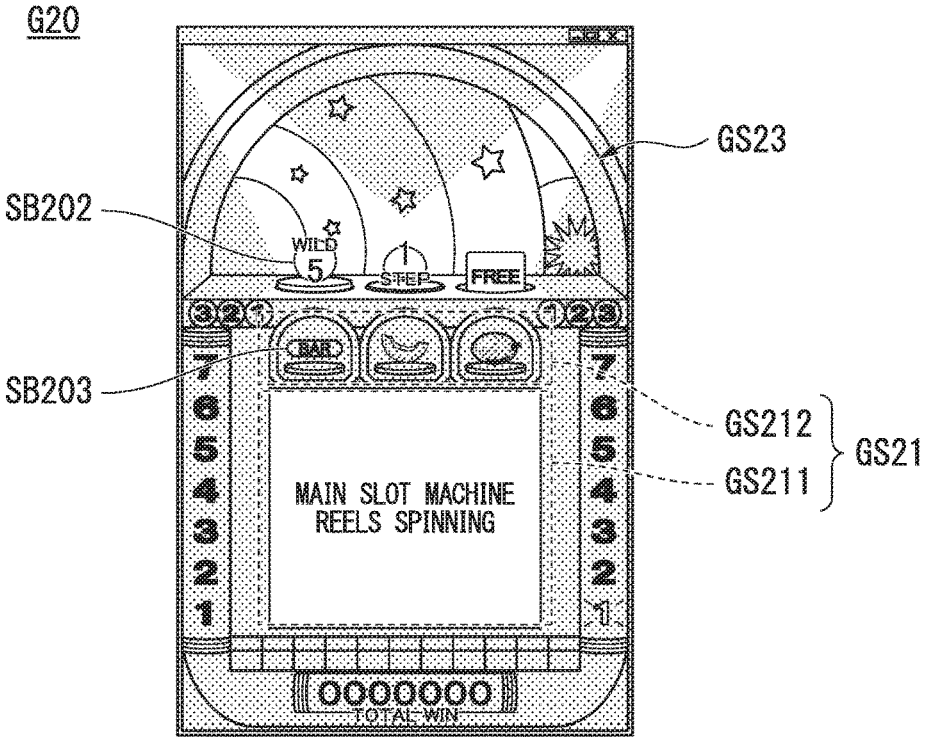
FIG. 21 shows an example of a game screen presenting a display of a drawing of symbol replacement in the reserved area.

FIG. 21 shows an example of the game screen displaying a presentation of a drawing for a replacement symbol in the reserved area. In the game screen G20 illustrated, the symbol replacement drawing screen G23 displays, as a presentation during the drawing, three symbols that are candidates as alternative symbol with respect to each of three symbols arranged in the reserved area GS212, these three symbols the displayed rotating clockwise like a roulette wheel. In this case, the symbols WILD5, Red Step 1, and FREE are displayed as alternative symbol candidates. In this case, the WILD symbol has the effect of a wildcard symbol that matches all types of symbols, and the numeral affixed thereto indicates in this case (WILD5) that the symbol can be used repeatedly (in the case of WILD5, five times). The FREE symbol has the effect of executing a prescribed game (free game). Regarding the WILD and the FREE symbols as well, dropping from the reserved area GS212 to the main area GS211 is enabling.

Figure 22:
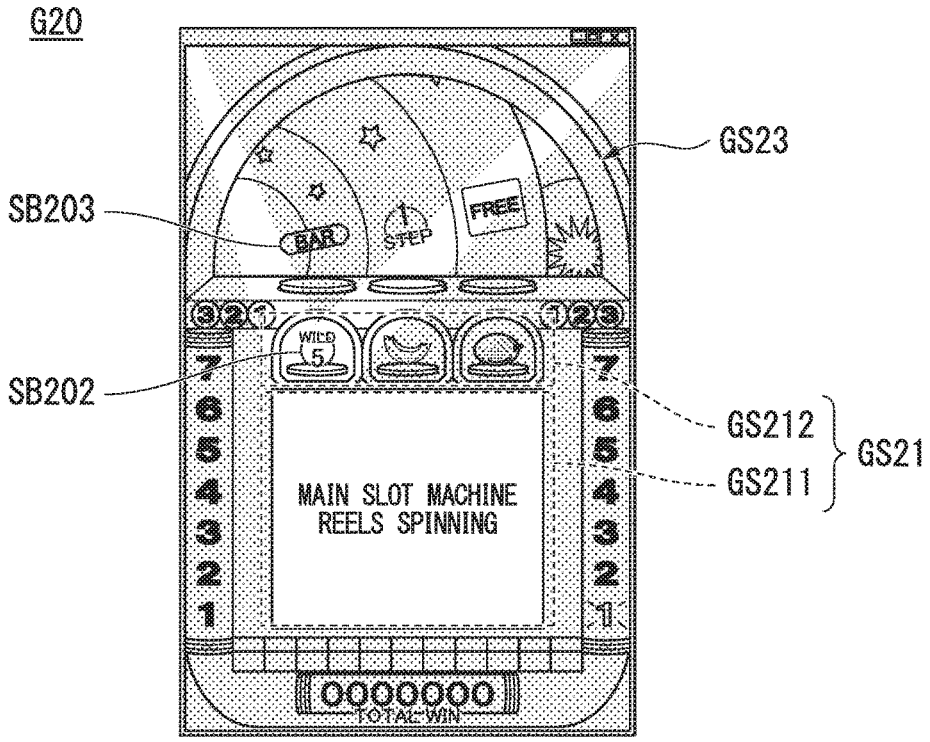
FIG. 22 shows an example of a game display after symbol replacement.

The reserved area GS212 also has arranged therein the BAR, melon, and plum symbols, from which a replacement target symbol is drawn. During symbol replacement in the reserved area GS212, the wheels spin, and the state is one in which the disposition of symbols is not determined. For example, if the BAR symbol SB203 is selected as the replacement target symbol, the WILD5 symbol 513202 that had been displayed as an alternative symbol with respect to the BAR symbol SB203 is established as the alternative symbol. This replaces the BAR symbol SB203 with the WILD5 symbol SB202. FIG. 22 shows an example of the game screen after the symbol replacement.

Figure 23:
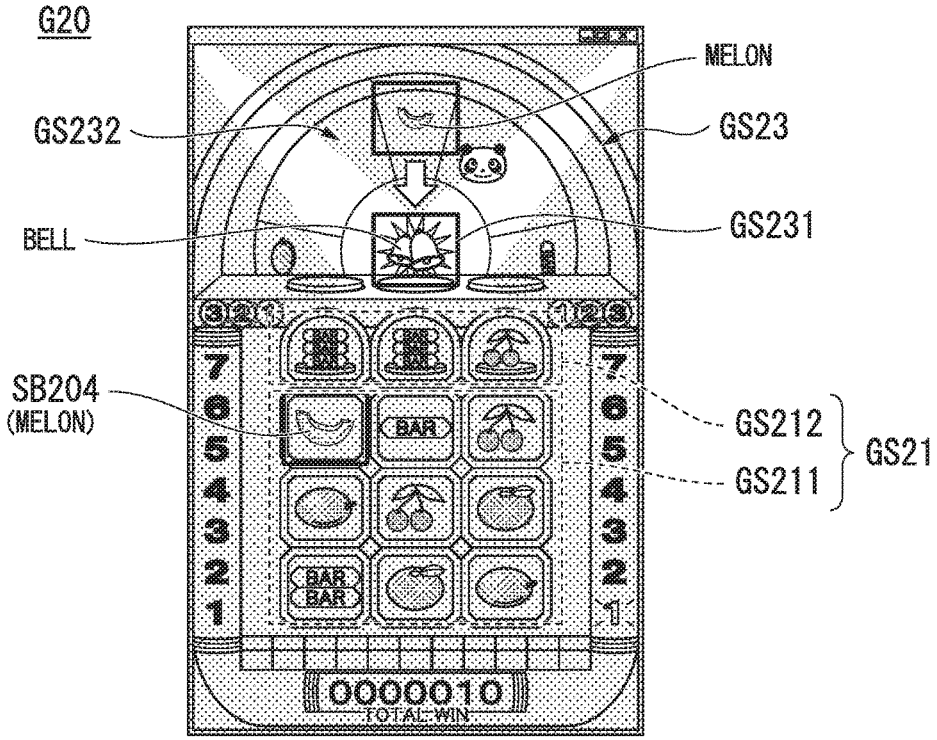
FIG. 23 shows an example of a game screen presenting a display of symbol replacement in the main area.

FIG. 23 shows an example of the game screen displaying a presentation of a drawing of symbol replacement in the main area. In the illustrated game screen G20, the symbol replacement drawing screen G23 displays a presentation the same as the symbol replacement drawing screen G13 shown in FIG. 2 and FIG. 3. The alternative symbol drawing presentation GS231 in the symbol replacement drawing screen G23 displays a presentation regarding the alternative symbol drawing. The replacement target symbol drawing presentation GS232 in the symbol replacement drawing screen G23 displays a presentation regarding the replacement target symbol drawing. The presentations displayed in the alternative symbol drawing presentation GS231 and the replacement target symbol drawing presentation GS232 are the same as the presentations displayed in the alternative symbol drawing presentation GS131 and the replacement target symbol drawing presentation GS132 shown in FIG. 2 and FIG. 3. For example, if the bell is drawn as the alternative symbol and the melon is drawn as the replacement target symbol, of the symbols arranged in the main area GS211, the melon symbol SB204 is replaced by the bell symbol.

In this case, in the symbol replacement drawing screen G23, the drawing of the alternative symbol may be made after the drawing of the replacement target symbol, and after the display of the alternative symbol drawing results, the result of the drawing of the replacement target symbol may be displayed. When this is done, of the symbols arranged in the main area GS211, the display format of the symbol corresponding to the drawing result may be changed, in accordance with the alternative symbol drawing result. For example, if the bell symbol is determined as the alternative symbol, during the drawing of the replacement target symbol, of the symbols arranged in the main area GS211, the display of the bell may be emphasized (for example, flashing, enlarged, or highlighted display). In accordance with the replacement target symbol drawing, of the symbols arranged in the main area GS211, the display format of the symbol corresponding to the drawing may be changed. For example, in the replacement target symbol drawing presentation GS232, during only the time that the replacement target symbol candidates pass through the 12 o'clock position when rotating in the clockwise direction, of the symbols arranged in the main area GS211, a symbol having the same type as the replacement target symbol passing through the 12 o'clock position may be temporarily changed to the determined alternative symbol.

(Functional Configuration of the Processing Executed by the MPU)

Next, the functional configuration of the MPU 17 as a game controller in the game apparatus 1A of the present embodiment executing game processing based on a program for controlling a game will be described.

Figures 24, 25:
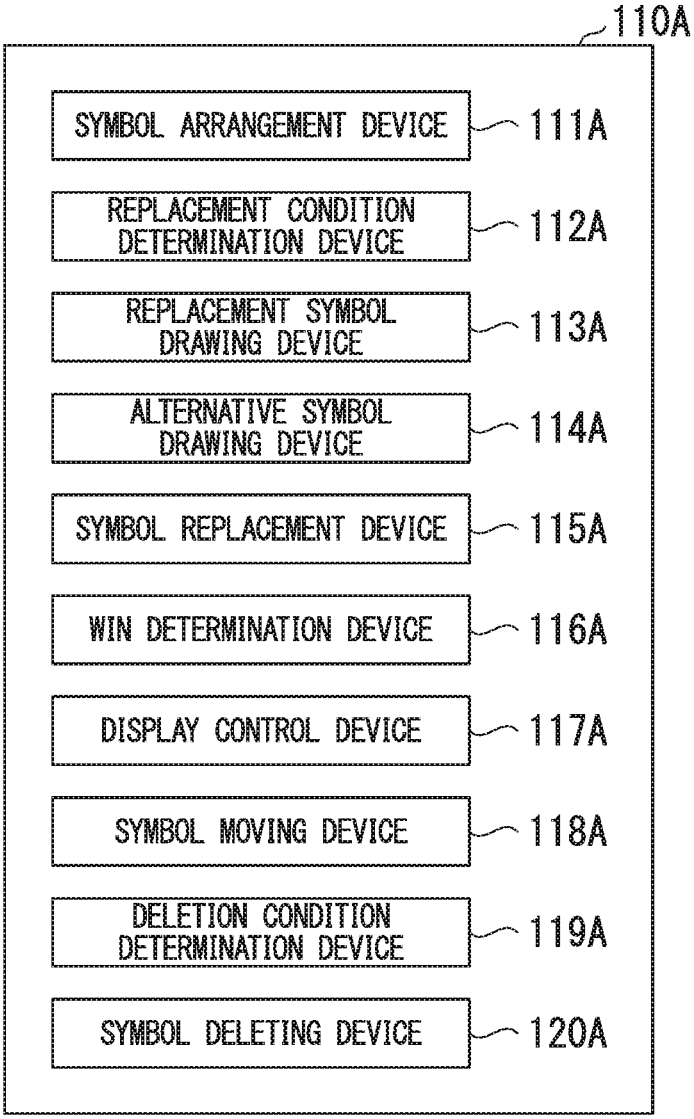
FIG. 24 shows an example of the functional configuration of a game controller according to the second embodiment.
FIG. 25 shows an example of the setting of the drawing probabilities when a drawing is made for the number of types of the replacement target symbols.

FIG. 24 shows an example of the functional configuration of the game controller 110A according to the present embodiment. The game controller 110A illustrated has a symbol arrangement device 111A, a replacement condition determination device 112A, a replacement symbol drawing device 113A, an alternative symbol drawing device 114A, a symbol replacement device 115A, a win determination device 116A, a display control device 117A, a symbol moving device 118A, a deletion condition determination device 119A, and a symbol deleting device 120A.

The symbol arrangement device 111A corresponds to the symbol arrangement device 111 shown in FIG. 4 and, in the present embodiment, arranges a plurality of symbols in each of the main area GS211, which is the target for a win determination in the slot machine screen GS21 and the reserved area GS212, which is not the target for a win determination.

The replacement condition determination device 112A corresponds to the replacement condition determination device 112 shown in FIG. 4 and, in the present embodiment, determines whether or not each of the replacement condition in the main area GS211 and the replacement condition in the reserved area GS212 are satisfied. For example, if there a red step or a blue step symbol arranged in at least a part of the main area GS211, the replacement condition determination device 112A updates the red step gauge GS241 or the blue step gauge GS251 by one step (a prescribed parameter). The replacement condition determination device 112A determines whether or not the symbol replacement condition is satisfied, based on a comparison of the red step gauge GS241 or the blue step gauge GS251 with a prescribed value (prescribed reference value). For example, if the steps in the red step gauge GS241 have reached 7, the replacement condition determination device 112A determines that symbol replacement condition in the main area GS211 is satisfied. If, however, the steps in the red step gauge GS241 have not reach 7, the replacement condition determination device 112A determines that the symbol replacement condition in the main area GS211 is not satisfied. If the blue step gauge GS251 has reached 7, the replacement condition determination device 112A determines that the symbol replacement condition in the reserved area GS212 is satisfied. If, however, the blue step gauge GS251 has not reached 7, the replacement condition determination device 112A determines that the symbol replacement condition in the reserved area GS212 is not satisfied.

The replacement condition determination device 112A may determine that the replacement condition is satisfied by the appearance of a specific symbol in the main area GS211 and may determine that the replacement condition is satisfied based on a prescribed amount of time elapsing from the start of the game. The replacement condition determination device 112A may determine that the replacement condition is satisfied based on the disposition state of symbols in the main area GS211 or the number of medals to be disbursed to a player.

The replacement symbol drawing device 113A corresponds to the replacement symbol drawing device 113 shown in FIG. 4 and, in the present embodiment, if either the symbol replacement condition in the main area GS211 or the symbol replacement condition in reserved area GS212 is satisfied, makes a replacement target symbol drawing for the area in which the replacement condition is satisfied.

For example, the replacement symbol drawing device 113A may draw the number of types of replacement target symbols and draw replacement target symbols of that number of types. The example illustrated is one in which, of the three types of symbols that could be replacement target symbols, the number of types of replacement target symbol to be selected by a drawing is drawn. In this case, the probability of the number of types of replacement target symbols selected by a drawing is zero (that is, a lose) is a %, the probability of one is b %, and the probability of two is c %, and the probability of three is d %. The probabilities a %, b %, c %, and d % can be set arbitrarily. In the drawing for replacement target symbols in the main area GS211, for example, the same processing as in the drawing for replacement target symbols in the slot machine screen GS11 according to the first embodiment can be applied.

The alternative symbol drawing device 114A corresponds to the alternative symbol drawing device 114 shown in FIG. 4 and, in the present embodiment, if either the replacement condition in either the main area GS211 or the replacement condition in the reserved area GS212 is satisfied, makes a replacement target symbol drawing in the area in which the replacement condition was satisfied.

FIG. 26 shows an example of settings of the probabilities of drawing types of replacement target symbols in the reserved area. The example illustrated is one in which the symbols that could be replacement target symbols are the four symbols of the WILD, FREE, blue step, and red step. For example, if one type of replacement target symbol is to be drawn from among the four types of symbols, the probability of WILD being selected is a %, the probability of FREE being selected is b %, the probability of blue step being selected is c %, and the probability of red step being selected is d %. In this case, the probabilities a %, b %, c %, and d %, for example, can be set arbitrarily so that their total is 100%, may be set to mutually different probabilities, and may be set so that some or all thereof are the same probability. Each of the probabilities a %, b %, c %, and d % may be set based on the probability of appearance or value of the corresponding symbols.

In the case of two replacement target symbol types of the four types of symbol being drawn as replacement target symbols, the probability of the WILD and the blue step symbols being selected is f %, the probability of the WILD and red step symbols being selected is g %, the probability of the FREE and the blue step symbols being selected is h %, and the probability of the FREE and red step symbols being selected is i %. In this case, the probabilities e %, f %, g %, h %, and i %, similar to the case of drawing one type of replacement target symbol and the like, can be arbitrarily set.

In the case of three replacement target symbol types of the three types of symbol being drawn as replacement target symbols, the probability of the drawing selecting three FREE symbols is j %, the probability of selecting two FREE symbols and a red step symbol is k %, and the probability of selecting two FREE symbols and a red step symbol is 1%. In this case, the probabilities j %, k %, and 1%, similar to the case of drawing one type of replacement target symbol and the like, can be arbitrarily set.

In the drawing for alternative symbols in the main area GS211, for example, the same processing as in the drawing for alternative symbols in the slot machine screen GS11 according to the first embodiment can be applied.

The symbol replacement device 115A corresponds to the symbol replacement device 115 shown in FIG. 4 and, in the present embodiment, in the main area GS211 and the reserved area GS212, replaces a replacement target symbol with an alternative symbol. For example, at different respective timings with regard to the main area GS211 and the reserved area GS212, the symbol replacement device 115A replaces the replacement target symbol selected by a drawing by the replacement symbol drawing device 113A with the alternative symbol selected by a drawing by the alternative symbol drawing device 114A. After symbols are arranged in the reserved area GS212 and also before a symbol drops from the reserved area GS212 into the main area GS211, the symbol replacement device 115A performs symbol replacement in the reserved area GS212.

The win determination device 116A corresponds to the win determination device 116 shown in FIG. 4 and, in the present embodiment, determines whether or not whether a win condition is satisfied, based on the disposition of symbol arranged in at least a part of the main area GS211. The win condition is, for example, a pre-established condition, such as all three symbols arranged on a winning line being the same type of symbols, a successive deletion of symbols occurring, or a combination thereof.

The display control device 117A corresponds to the display control device 117 shown in FIG. 4 and causes various game screens to be displayed on the display device 14.

The symbol moving device 118A moves a symbol arranged in the reserved area GS212 to the main area GS211. For example, if a symbol is not arranged in at least the uppermost row within the main area GS211, the symbol moving device 118A causes a symbol arranged in the reserved area GS212 to drop into the main area GS211.

The deletion condition determination device 119A determines whether or not the deletion condition is satisfied, based on the disposition of symbols in at least a part of the main area GS211. For example, if three symbols arranged on a deletion line of eight deletion lines in the main area GS211, which are three vertical, three horizontal, and two diagonal lines are all the same type lines, the deletion condition determination device 119A determines that the deletion condition is satisfied. If, in the main area GS211, in a disposition state in which at least three symbol of the same type are arranged contiguously, the deletion condition determination device 119A determines that the deletion condition is satisfied.

If the deletion condition determination device 119A determines that the deletion condition is satisfied, the symbol deleting device 120A deletes the symbol for which the deletion condition is satisfied from the main area GS211. When this is done, the symbol deleting device 120A causes a symbol arranged above the location in which the deleted symbol had been located to drop into that position.

(Operation of Game Processing)

Next, the operation of game processing according to the present embodiment will be described.

Figure 27:
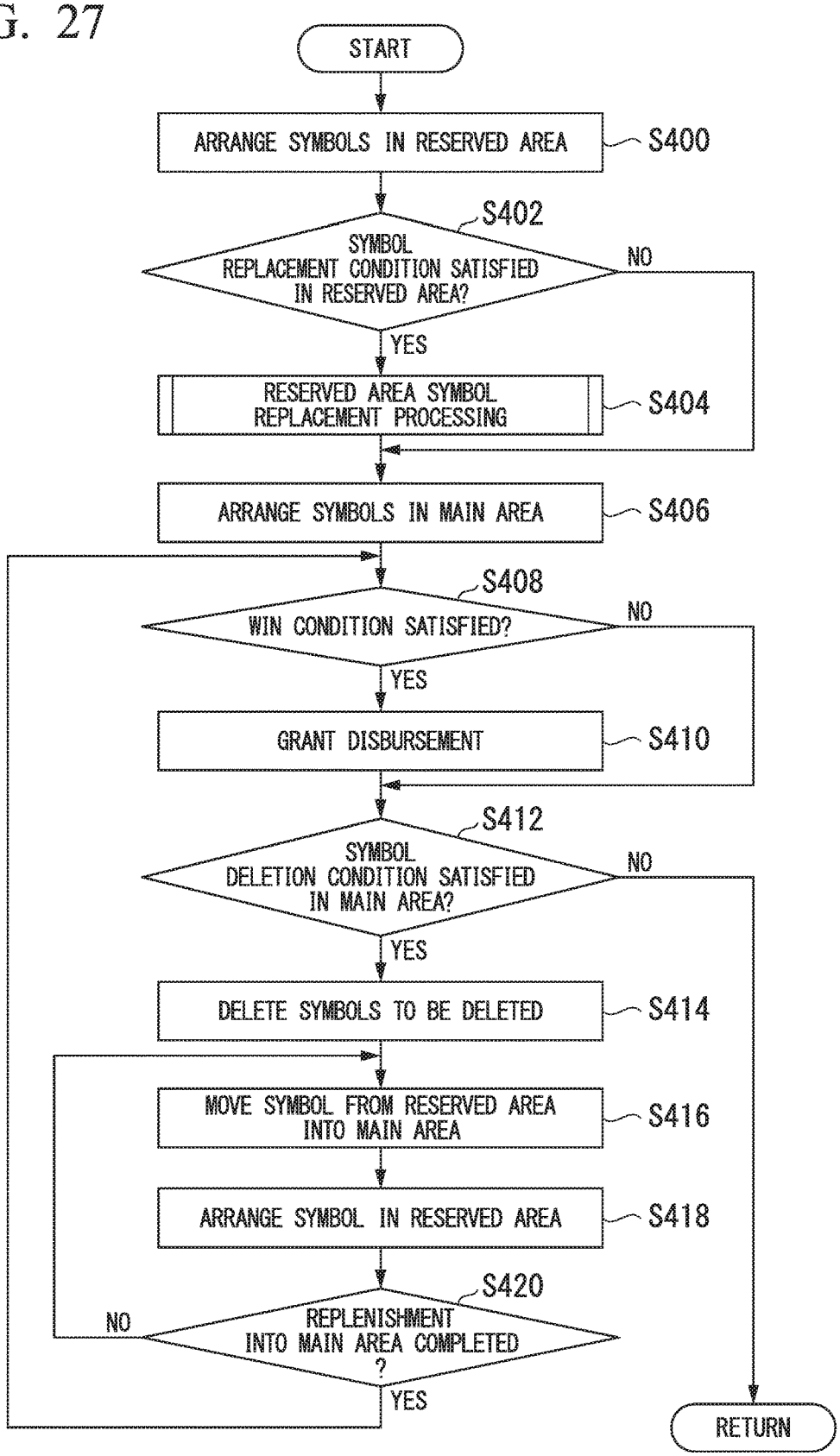
FIG. 27 is a flowchart showing a first example of game processing according to the second embodiment.

FIG. 27 is a flowchart showing a first example of game processing according to the present embodiment. This drawing shows an example of game processing related to symbol replacement in the reserved area GS212.

First, when a player presses the start button 11, the game controller 110A acquires a game start signal and arranges a plurality of symbols (for example, three) in the reserved area GS212 (step S400).

Next, the game controller 110A determines whether or not the symbol replacement condition in the reserved area GS212 is satisfied (step S402). If the game controller 110A determines that the symbol replacement condition in the reserved area GS212 is satisfied (YES), it executes symbol replacement processing in the reserved area GS212 (step S404). For example, the game controller 110A makes a drawing for the type of replacement target symbol and the type of alternative symbol to replace the replacement target symbol and, based on the drawing results, replaces the replacement target symbol arranged in the reserved area GS212 with the alternative symbol. If, however, the game controller 110A determines that the symbol replacement condition is not satisfied in the reserved area GS212 (NO), it does not execute symbol replacement processing in the reserved area GS212.

Next, the game controller 110A arranges a plurality (for example, nine) symbols in the main area GS211 (step S406). Then the game controller 110A, based on the disposition of symbols in at least a part of the main area GS211, determines whether or not the win condition is satisfied (step S408). If the game controller 110A determines that the win condition is satisfied (YES), it grants a disbursement to the player (step S410). If, however, the game controller 110A determines that the win condition is not satisfied (NO), it does not grant a disbursement to the player.

Next, the game controller 110A determines whether or not the symbol deletion condition is satisfied in the main area GS211 (step S412). If the game controller 110A determines that the deletion condition is satisfied (YES), it deletes symbols to be deleted (step S414). If, however, the game controller 110A determines that the deletion condition is not satisfied (NO), it returns to the processing of step S400.

Next, to replenish the symbol that was deleted from the main area GS211, the game controller 110A moves a symbol in the reserved area GS212 by dropping it into the main area GS211 (step S416). Then, to replenish the symbol that it had caused to drop from the reserved area GS212, the game controller 110A arranges a new symbol (step S418).

Continuing, the game controller 110A determines whether or not the symbol replenishment into the main area GS211 has been completed (step S420). If there are eight or fewer symbol arranged in the main area GS211 (NO), the game controller 110A determines that the replenishment is not completed (NO) and returns to the processing of step S416. The game controller 110A also causes a symbol of the reserved area GS212 to drop into the main area GS211. If, however, the game controller 110A determines that there are nine symbols arranged in the main area GS211 (YES), return is made to the processing of step S408. The game controller 110A then performs a win determination with respect to the re-positioned symbols after deletion and, if the win condition is satisfied, it grants a disbursement to the player. After that, if the symbol deletion condition is no longer satisfied in the main area GS211, the game controller 110A returns to the processing of step S400.

Figure 28:
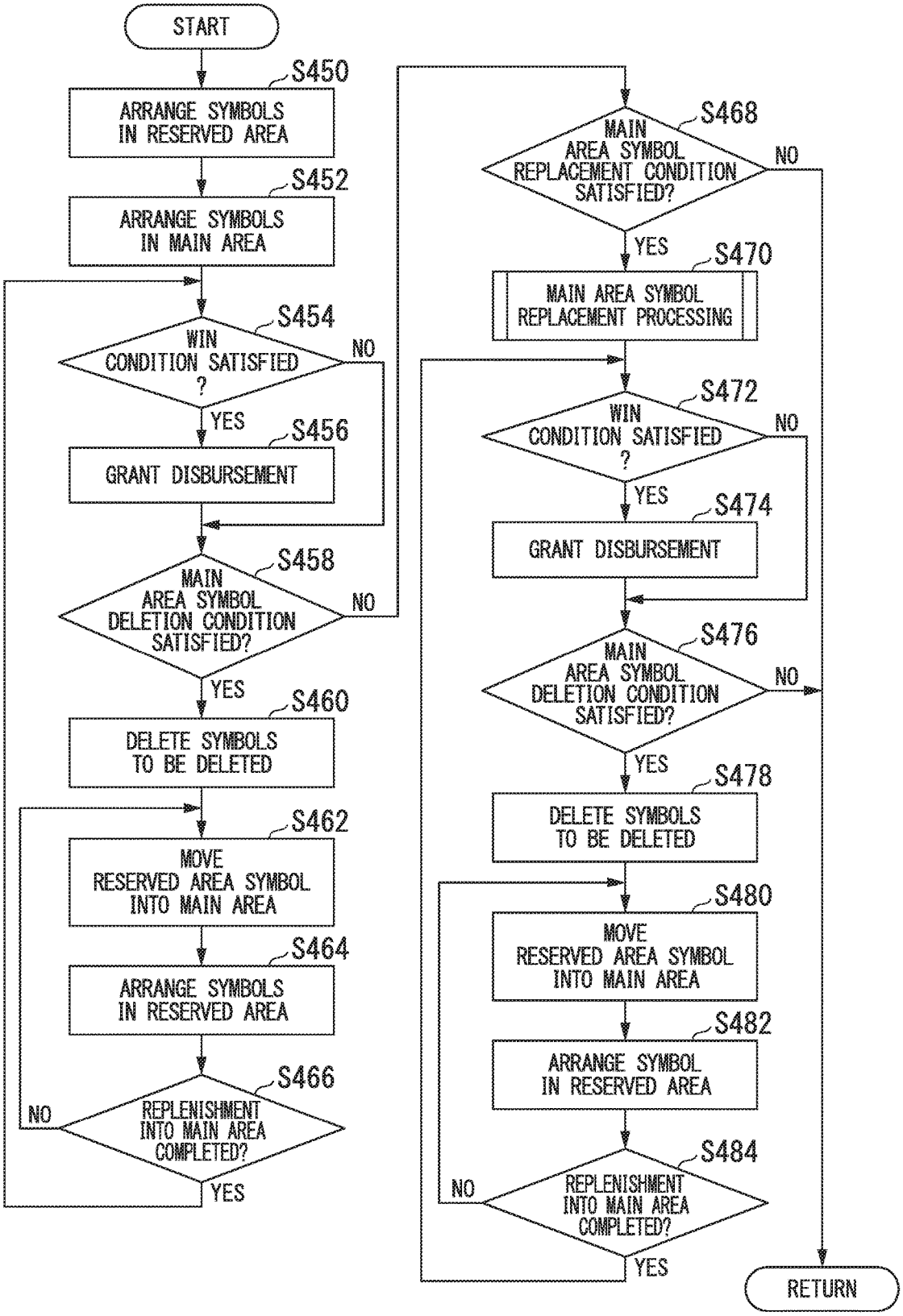
FIG. 28 is a flowchart showing a second example of game processing according to the second embodiment.

Next, referring to FIG. 28, the operation of game processing regarding symbol replacement in the main area GS211 will be described. FIG. 28 is a flowchart showing a second example of game processing according to the present embodiment, which shows an example of the game processing related to symbol replacement processing in the main area GS211.

First, when a player presses the start button 11, the game controller 110A acquires a game start signal and arranges a plurality of symbols (for example, three) in the reserved area GS212 (step S450).

Next, the game controller 110A arranges a plurality of symbols (for example, nine) in the main area GS211 (step S452). Then, the game controller 110A determines whether or not the win condition is satisfied, based on the disposition of symbols in at least a part of the main area GS211 (step S454). If the determination is that the win condition is satisfied (YES), the game controller 110A grants a disbursement to the player (step S456). If, however, the determination is that the win condition is not satisfied (NO), the game controller 110A does not grant a disbursement to the player.

Next, the game controller 110A determines whether or not the symbol deletion condition has been met in the main area GS211 (step S458). If the determination is that the symbol deletion condition is not satisfied (NO), the game controller 110A proceeds to the processing of step S468.

If, however, the determination is that the symbol deletion condition has be satisfied (YES), the game controller 110A deletes symbols to be deleted (step S460). Next, to replenish a symbol that was deleted from the main area GS211, the game controller 110A causes a symbol in the reserved area GS212 to drop down, moving to the main area GS211 (step S462). In the case in which a symbol from the reserved area GS212 drops down, a new symbol appears in the reserved area GS212 (step S464).

Next, the game controller 110A determines whether or not the symbol replenishment into the main area GS211 has been completed (step S466). If there are eight or fewer symbol arranged in the main area GS211 (NO), the game controller 110A determines that the replenishment is not completed (NO) and returns to the processing of step S462. The game controller 110A also causes a symbol of the reserved area GS212 to drop and move into the main area GS211. If, however, the game controller 110A determines that there are nine symbols arranged in the main area GS211 (YES), return is made to the processing of step S454. The game controller 110A then performs a win determination with respect to the re-positioned symbols after deletion and, if the win condition is satisfied, grants a disbursement to the player. After that, if the symbol deletion condition is no longer satisfied in the main area GS211, the game controller 110A returns to the processing of step S468.

At step S468, the game controller 110A determines whether or not the symbol replacement condition is satisfied in the main area GS211. If the determination is that the symbol replacement condition is satisfied (YES), the game controller 110A executes symbol replacement processing (step S470). For example, the game controller 110A makes a drawing of the replacement target symbol type and the alternative symbol type with which the replacement target symbol is to be replaced and, based on the results of the drawings, replaces a replacement target symbol arranged in the main area GS211 with the alternative symbol. If, however, the game controller 110A determines that the symbol replacement condition has not be satisfied (NO), it returns to the processing of FIG. S450 without executing symbol replacement in the main area GS211.

Next, the game controller 110A, after executing symbol replacement processing in the main area GS211 at step S470, determines whether or not the win condition is satisfied, based on the symbol disposition in at least a part of the main area GS211 (step S472). If the game controller 110A determines that the win condition is satisfied (YES), it grants a disbursement to the player (step S474). If, however, the game controller 110A determines that the win condition is not satisfied (NO), it does not grant a disbursement to the player.

Next, the game controller 110A determines whether or not the symbol deletion condition is satisfied in the main area GS211 (step S476). If the game controller 110A determines that the symbol deletion condition is not satisfied (NO) it returns to the processing of step S450.

If, however, the game controller 110A determines that the symbol deletion condition is satisfied (YES), it deletes the symbol to be deleted (step S478). Next, the game controller 110A, to replenish the symbol that has been deleted from the main area GS211, causes a symbol in the reserved area GS212 to drop into the main area GS211 (step S480). The game controller 110A arranges a new symbol in the reserved area GS212 to replenish the symbol that had be dropped (step S482).

Next, the game controller 110A determines whether or not the symbol replenishment into the main area GS211 has been completed (step S484). If there are eight or fewer symbol arranged in the main area GS211, the game controller 110A determines that the replenishment is not completed (NO) and returns to the processing of step S480. The game controller 110A then further causes a symbol of the reserved area GS212 to drop into the main area GS211. If, however, there are nine symbols arranged in the main area GS211, the game controller 110A determines that the replenishment has been completed (YES), and returns to the processing of step S472. The game controller 110A makes a win determination with respect to the symbols arranged after deletion and, if the win condition is satisfied, grants a disbursement to the player. After that, if the symbol deletion condition is no longer satisfied in the main area GS211, return is made to the processing of step S450.

(Symbol Replacement Processing in the Reserved Area)

Figure 29:
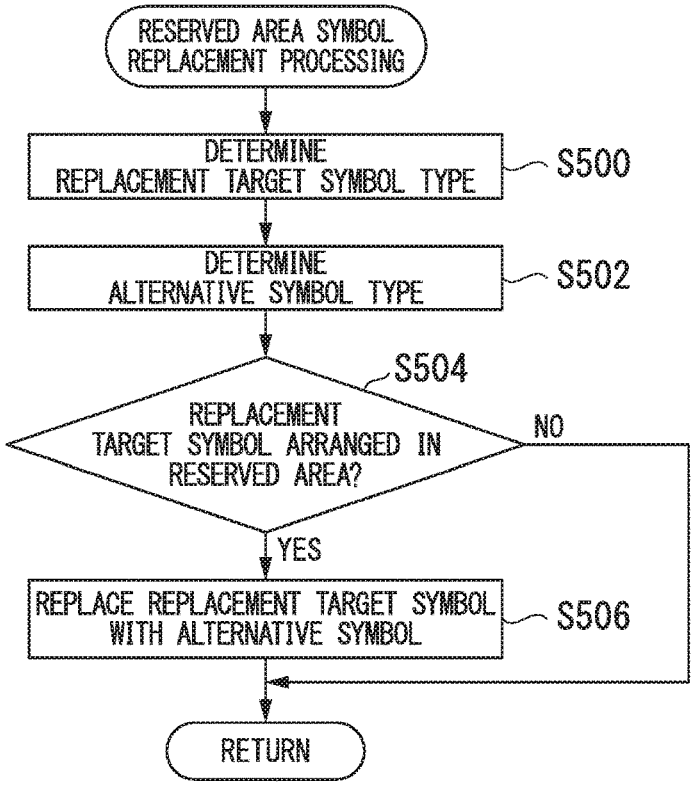
FIG. 29 is a flowchart showing a first example of reserved area symbol replacement processing.

Next, referring to FIG. 29, the specific operation for the processing of symbol replacement in the reserved area GS212 (step S404 in FIG. 27) will be described. FIG. 29 is a flowchart showing a first example of the symbol replacement processing in the reserved area GS212.

First, the game controller 110A makes a drawing of the type of the replacement target symbol to determine the type of the replacement target symbol (step S500). The game controller 110A also makes a drawing of the type of the alternative symbol to determine the type of alternative symbol (step S502).

Next, the game controller 110A determines whether or not the determined type of replacement target symbol is arranged in the reserved area GS212 (step S504). If the game controller 110A determines that the replacement target symbol is arranged in the reserved area GS212 (YES), it replaces the replacement target symbol with an alternative symbol (step S506). If, however, the game controller 110A determines that the replacement target symbol is not arranged in the reserved area GS212 (NO), it does not perform symbol replacement. The game controller 110A ends the symbol replacement processing in the reserved area GS212 and returns to the processing of FIG. 27.

(Other Examples of Symbol Replacement Processing in the Reserved Area)

Next, referring to FIG. 30 to FIG. 33, operation in other examples of symbol replacement in the reserved area GS212 will be described.

Figure 30:
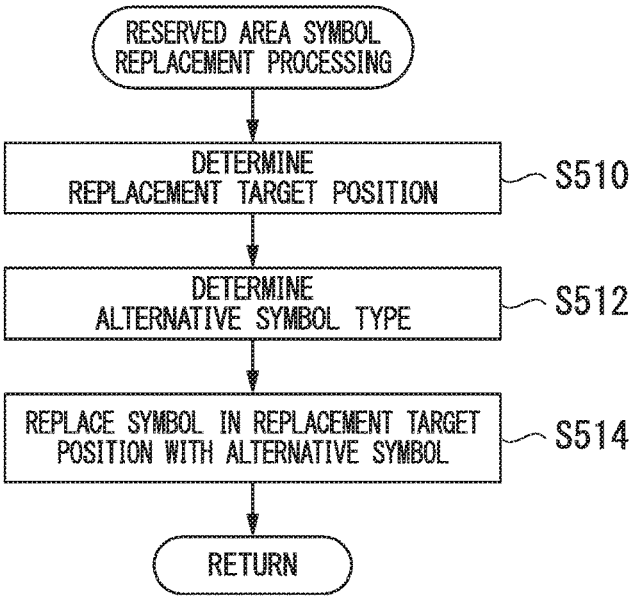
FIG. 30 is a flowchart showing a second example of reserved area symbol replacement processing.

FIG. 30 is a flowchart of a second example of symbol replacement in the reserved area GS212. The example illustrated is one in which the position of a symbol in the reserved area GS212 to be made the replacement target is drawn. First, the game controller 110A draws to determine the position (replacement target position) of the reserved area GS212 of a symbol to be the replacement target (step S510). The game controller 110A also draws to determine the type of the replacement target symbol (step S512). If the game controller 110A determines a plurality of replacement target areas, the types of the replacement target symbol for each replacement target area are drawn. The game controller 110A replaces the symbol in the replacement target area as the replacement target symbol with the alternative symbol (step S514).

Figure 31:
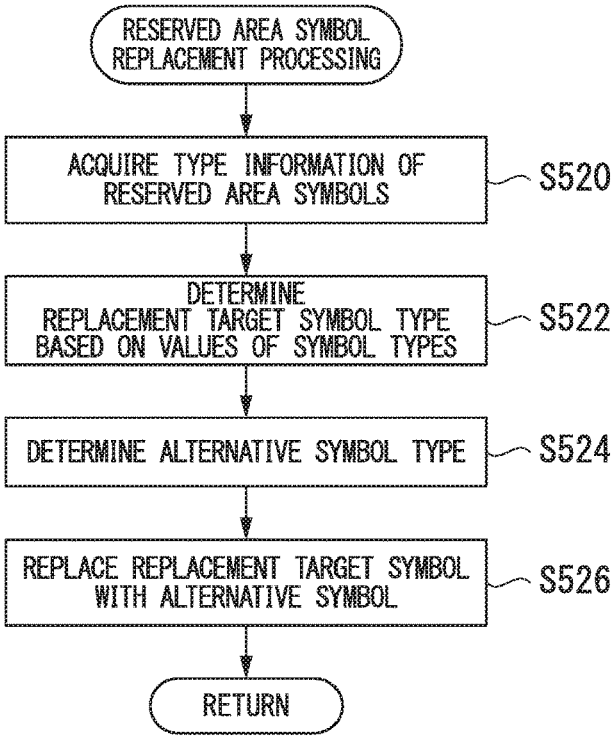
FIG. 31 is a flowchart showing a third example of reserved area symbol replacement processing.

FIG. 31 is a flowchart showing the third example of symbol replacement processing in the reserved area GS212. The example illustrated is one in which the type of the replacement target symbol is determined based on the value of the type of symbols arranged in the reserved area GS212. First, the game controller 110A acquires type information of the symbols arranged in the reserved area GS212 (step S520). Next, the game controller 110A references the acquired type information and determines the replacement target symbol type based on the values of the types of symbols arranged in the reserved area GS212 (step S522). For example, the game controller 110A determines the type of the replacement target symbol based on the ranking of the values of the types of symbols arranged in the reserved area GS212. Specifically, the game controller 110A, for example, determines as the replacement target symbol type the type that, of the symbol types arranged in the reserved area GS212, has the lowest value. The game controller 110A performs a drawing of the alternative symbol to determine the type of the alternative symbol (step S524). The game controller 110A then replaces the replacement target symbol with the alternative symbol (step S526).

Figure 32:
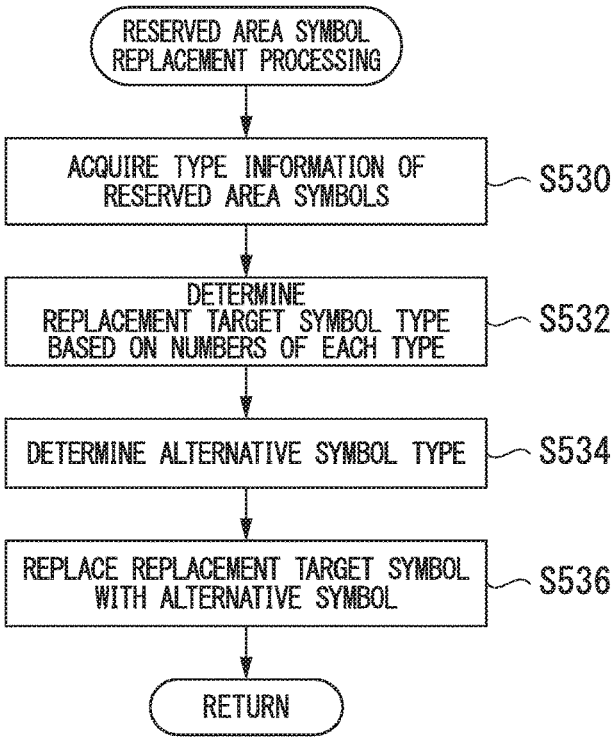
FIG. 32 is a flowchart showing a fourth example of reserved area symbol replacement processing.

FIG. 32 is a flowchart of a fourth example of symbol replacement in the reserved area GS212. The example illustrated is one in which the type of the replacement target symbol is determined based on the number of types of symbols arranged in the reserved area GS212. First, the game controller 110A acquires type information of the symbols arranged in the reserved area GS212 (step S530). Next, the game controller 110A references the acquired type information and determines the type of the replacement target symbol based on the number of types of symbols arranged in the reserved area GS212 (step S532). For example, the game controller 110A determines as the replacement target symbol the type of symbol that is either the most numerous or the least numerous of the symbols arranged in the reserved area GS212. The game controller 110A may determine a plurality of types of symbols as the replacement target symbols, based on the number of types of symbols arranged in the reserved area GS212. The game controller 110A makes a drawing of the type of the alternative symbol to determine the alternative symbol type (step S534). The game controller 110A then replaces the replacement target symbol with the alternative symbol (step S536).

Figure 33:
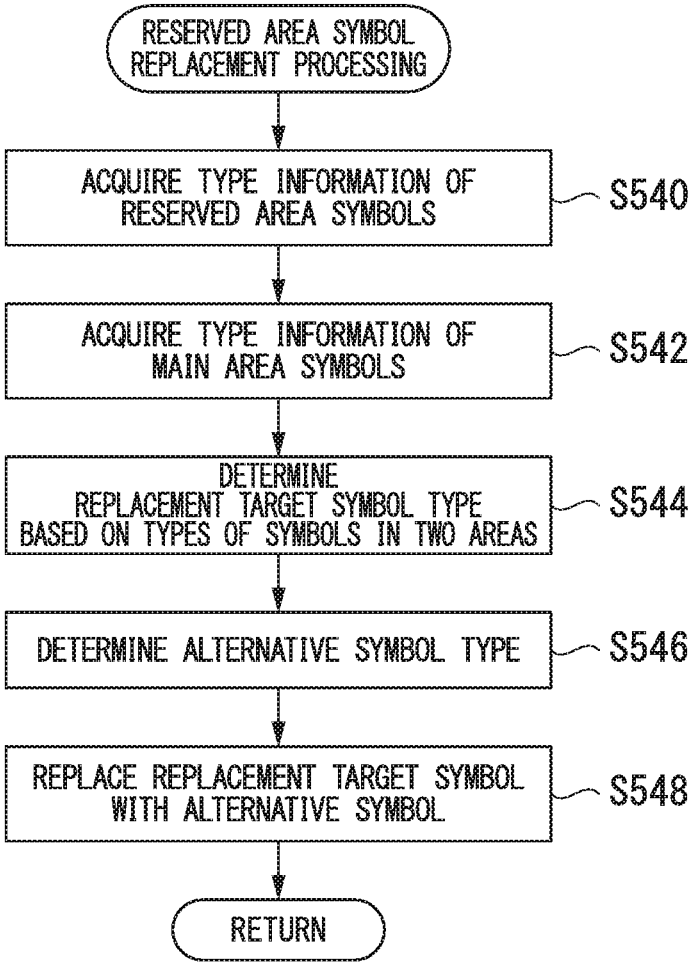
FIG. 33 is a flowchart showing a fifth example of reserved area symbol replacement processing.

FIG. 33 is a flowchart showing a fifth example of the symbol replacement processing in the reserved area GS212. The illustrated example is one in which the type of the replacement target symbol in the reserved area GS212 is drawn based on both the type of symbols arranged in the reserved area GS212 and the type of symbols arranged in the main area GS211. First, the game controller 110A acquires type information regarding the type of symbols arranged in the reserved area GS212 (step S540). The game controller 110A also acquires type information regarding the type of symbols arranged in the main area GS211 (step S542). The game controller 110A draws to determine the type of replacement target symbol in the reserved area GS212 based on the acquired type information of the two areas (step S544). For example, the game controller 110A determines as the type of the replacement target symbol a type of symbol, of the symbols arranged in the reserved area GS212, that is not arranged in the main area GS211, based on the acquired type information. That is, if a symbol exists in the reserved area GS212 having the same type as a symbol arranged in the main area GS211, the game controller 110A, rather than replacing that symbol, gives priority to making a symbol existing in the reserved area GS212 that does not exist in the main area GS211 a replacement target. Next, the game controller 110A draws the type of the alternative symbol determine the alternative symbol type (step S546). The game controller 110A then replaces the replacement target symbol with the alternative symbol (step S548).

(Main Area Symbol Replacement Processing)

In the symbol replacement processing (step S470 in FIG. 28) in the main area GS211 according to the present embodiment, the symbol replacement processing in the slot machine screen GS11 according to the first embodiment, which was described with references made to FIG. 10 to FIG. 15, can be applied.

(Symbol Replacement Condition Determination Processing)

Figure 34:
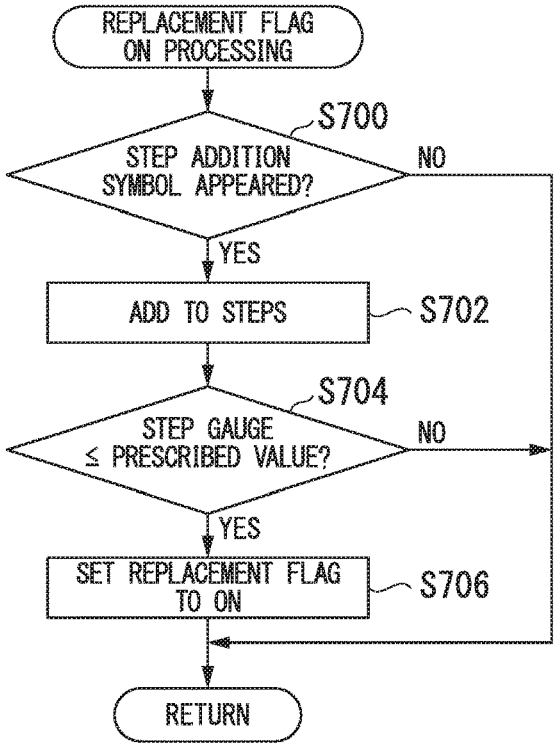
FIG. 34 is a flowchart showing an example of replacement flag on processing according to the second embodiment.

Next, referring to FIG. 34 and FIG. 35, the operation of the symbol replacement condition determination will be described. FIG. 34 is a flowchart showing an example of the symbol replacement flag on processing according to the present embodiment. The description will be of the operation of symbol replacement flag on processing in the case in which the symbol replacement condition is satisfied by a step gauge reaching or exceeding a prescribed value (prescribed number of steps) in response to a step symbol ("step (addition)") dropping from the reserved area GS212 into the main area GS211.

The game controller 110A determines whether or not a step symbol has appeared in the main area GS211 (step S700). If the game controller 110A determines that a step symbol has appeared in the main area GS211 (YES) it makes a step addition to the step gauge (step S702). For example, if the game controller 110A determines that a Red Step 1 symbol has appeared in the main area GS211, it adds one to the steps of the red step gauge GS241. If, however, the game controller 110A determines that a step symbol has not appeared in the main area GS211 (NO), it executes the processing of step S700 again.

Next, the game controller 110A determines whether or not the step gauge is at or above a prescribed value (for example seven) (step S704). If the game controller 110A determines that the step gauge is at or above the prescribed value (YES), it sets the replacement flag to on (step S706). If, however, the game controller 110A determines that the step gauge is below the prescribed value (NO), it returns to the processing of FIG. S700 without changing the replacement flag.

Figure 35:
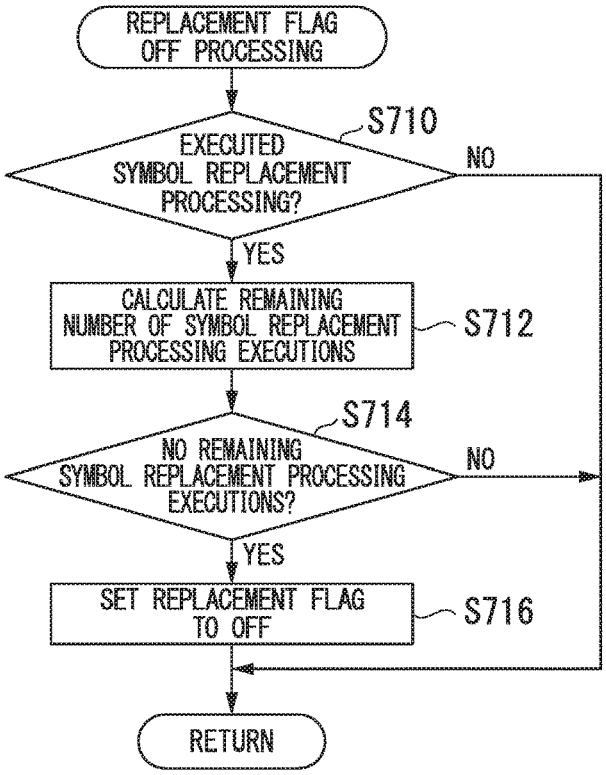
FIG. 35 is a flowchart showing an example of replacement flag off processing according to the second embodiment.

FIG. 35 is a flowchart of an example of the symbol replacement flag off processing according to the present embodiment. The description is that of the operation of the replacement flag off processing when the symbol replacement processing is ended upon execution of symbol replacement three times.

The game controller 110A determines whether or not symbol replacement was executed in an area in which the symbol replacement condition had been satisfied (step S710). If the game controller 110A determines that symbol replacement was not executed (NO), it again executes the processing of step S710. If, however, the game controller 110A determines that symbol replacement was executed (YES), it reduces the number of remaining times of symbol replacement execution (for example, by one) (step S712).

Next, the game controller 110A determines whether or not there are any remaining times that symbol replacement can be executed (step S714). If the game controller 110A determines that there are no remaining times that symbol replacement can be executed (YES), it sets the symbol replacement flag to off (step S716). If, however, the game controller 110A determines that there is a remaining number of times that symbol replacement can be executed (NO), it returns to the processing of step S710 without changing the replacement flag.

(Another Example of Symbol Replacement Condition Determination)

Figure 36:
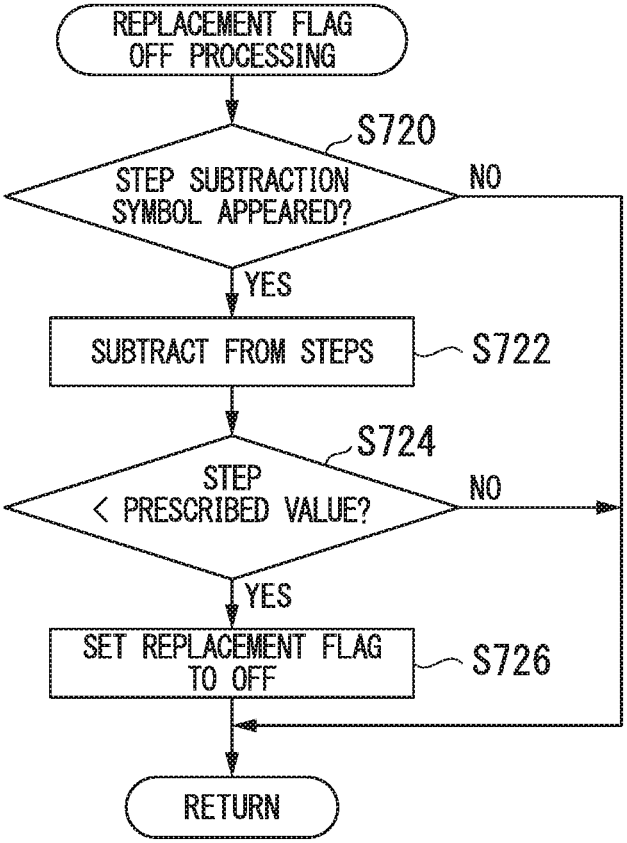
FIG. 36 is a flowchart showing another example of replacement flag off processing according to the second embodiment.

FIG. 36 is a flowchart showing another example of symbol replacement condition determination according to the present embodiment. In this case, the description is of the operation of replacement flag off processing for the case in which the symbol replacement condition is no longer satisfied because of a step gauge falling below a prescribed value (prescribed number of steps) in response to the appearance of a symbol that subtracts steps ("step (subtraction)").

The game controller 110A determines whether or not a step (subtraction) symbol as appeared in the main area GS211 (step S720). If the game controller 110A determines that a step (subtraction) symbol has appeared in the main area GS211 (YES), it subtracts steps from the step gauge (step S722). For example, if the game controller 110A determines that a Red Step 1 (subtraction) symbol has appears, it subtracts one from the steps of the red step gauge GS241. If, however, the game controller 110A determines that a step (subtraction) symbol has not appeared in the main area GS211 (NO), it executes the processing of step S720.

Next, the game controller 110A determines whether or not the step gauge is below a prescribed value (for example, seven) (step S724). If the game controller 110A determines that the step gauge is below the prescribed value (YES), it sets the replacement flag to off (step S726). If, however, the game controller 110A determines that the step gauge is not below the prescribed value (NO), it returns to the processing of step S720 without changing the replacement flag.

(Summary of the Second Embodiment)

As described above, the game apparatus 1A according to the present embodiment has a symbol arrangement device 111A, a replacement symbol drawing device 113A, a symbol replacement device 115A, and a win determination device 116A. The symbol arrangement device 111A arranges a plurality of symbols on the slot machine screen GS21 (an example of a prescribed area). In this case, the slot machine screen GS21 (an example of a prescribed area) includes a main area GS211 in which a first replacement condition is set and a reserved area GS212 in which a second replacement condition is set. The replacement symbol drawing device 113A draws a symbol (replacement target symbol) that is the replacement target for the main area GS211 or the reserved area GS212. After at least some symbols of the plurality of symbols are arranged by the symbol arrangement device 111A, the symbol replacement device 115A replaces the symbol (replacement target symbol) selected by the drawing by the replacement symbol drawing device 113A with another symbol (alternative symbol). The win determination device 116A makes a win determination, based on the disposition of symbols in at least a part of the main area GS211 after the symbol replacement by the symbol replacement device 115A.

Because the game apparatus 1A can randomly change the replacement target symbol when symbol replacement is done in the slot machine screen GS21 that includes the main area GS211 and the reserved area GS212, it can impart unexpectedness or variety regarding the symbol replacement.

Specifically, the game apparatus 1A has replacement condition determination device 112A that that determines whether or not each of the first replacement condition set in the main area GS211 and the second replacement condition set in the reserved area GS212 have been satisfied. If either the first replacement condition or the second replacement condition is satisfied, the replacement symbol drawing device 113A draws the symbol (replacement target symbol) that is the target for replacement in the area in which the replacement condition is satisfied.

Because the game apparatus 1A can set different replacement conditions in the main area GS211 and the reserved area GS212, it can impart unexpectedness or variety regarding symbol replacement.

The symbol replacement device 115A, at different respective timings with regard to the main area GS211, in which the first replacement condition is set, and the reserved area GS212, in which the second replacement condition is set, replaces the above-noted symbol that is the target for replacement (replacement target symbol) selected by a drawing by the replacement symbol drawing device 113A as the target for symbol replacement with another symbol (alternative symbol). By doing this, the game apparatus 1A performs symbol replacement with a timing that suits each area.

The win determination device 116A performs a win determination both before and after the symbol replacement by the symbol replacement device 115A. By doing this, the game apparatus 1A can makes is easier for a win to occur, thereby enabling the imparting of variety to the game progression.

The slot machine screen GS21 (an example, of a prescribed area) includes an area (for example, the main area GS211), in which a win determination is performed, and an area (for example, the reserved area GS212) in which a win determination is not performed. The game apparatus 1A also has a symbol moving device 118A, which moves a symbol arranged in the reserved area GS212 into the main area GS211. For example, after a symbol is arranged in the reserved area GS212 and before a symbol is arranged in the reserved area GS212, the symbol replacement device 115A performs a symbol replacement of a symbol of the reserved area GS212. By doing this, because the game apparatus 1A can replace with a symbol that is more effective or has a higher value before a symbol in the reserved area GS212 is caused to drop into the main area GS211, it can make it easier for a win to occur and impart variety to the game progression.

If a specific symbol (for example, a step symbol) is arranged in at least a part of the slot machine screen GS21 (an example of a prescribed area), the replacement condition determination device 112A updates a prescribed parameter (for example, the step gauge steps) and determines whether or not the symbol replacement condition is satisfied, based on a comparison between the prescribed parameter and a prescribed reference value (a prescribed number of steps, such as seven). By doing this, the game apparatus 1A can heighten the enjoyment in the game regarding satisfying the symbol replacement condition.

(Variation Example)

Although embodiments of the present invention have been described in detail, with references made to the drawings, the specific configuration is not restricted to the above-described embodiments and encompasses designs and the like within the scope of the spirit of the present invention. For example, the constituent elements described above in the first and second embodiments can be arbitrarily combined.

Although the above-noted embodiments have been described for the example in which a disbursement is made by a win determination the win determination is not restricted to being for the purpose of granting a disbursement. For example, the win determination may be for the purpose of transitioning to a secondary game or bonus game (free game).

Although the above-noted embodiments have been described for the example in which the alternative symbol is determined by a drawing, the alternative symbol may be determined by a method other than a drawing. For example, the alternative symbol may be set to a specific type of symbol beforehand, may be selected in sequence from a plurality of types of symbols, or may be symbols that have a one-to-one correspondence with the replacement target symbol types.

As a symbol, a medal, a card, a coin, or a ball or the like may be used as a game object.

A program for implementing the functions of the above-described game controllers 110 and 110A may be recorded in a computer-readable recording medium, the program recorded in the recording medium being read into a computer system and executed so as to perform processing as the game controllers 110 and 110A. In this case, "program recorded in recording medium being read into a computer system and executed" includes installation of the program into a computer system. The term "computer system" includes an operating system and hardware such as peripheral devices. The "computer system" may also include a plurality of computers connected via a network, which includes the Internet, a WAN, a LAN, or a dedicated communication circuit. The term "computer-readable recording medium" refers to a removable medium such as a flexible disk, an optomagnetic disk, a ROM, a CD-ROM, or the like, or a storage device such as a hard-disk drive or the like built into a computer system. In this manner, the recording medium into which the program is stored may a non-volatile recording medium such as a CD-ROM. The recording medium may be internally or externally provided recording medium that can be accessed from a distribution server for distributing the program. The code of the program stored in the recording medium of the distribution server may be different from the code of a program of a format that can be executed in a terminal device. That is, as long as downloading and installation from a distribution serve are done to enable execution in a terminal device, there is no restriction on the format in which storage is done on the distribution server. The program may be divided into multiple parts that are downloaded at different times and merged later at a terminal device, and the divided program parts may be stored in different distribution servers. Additionally, the term "computer-readable recording medium" includes one holding a program for a given period of time, such as a volatile memory (RAM) within a computer system serving as a server or client in the case in which a program is transmitted via a network such as the Internet. The above-noted program may be for implementing a part of the above-described functionality. Additionally, it may be a so-called difference file (difference program) enabling a combination with a program that already has recorded the above-noted functionality in a computer system.

A part or all of the functions of the above-described game controllers 110 and 110A may be implemented as an integrated circuit, such as an LSI (large-scale integration) device. Each of the above-described functions may be implemented as separate processors or a part or all thereof may be integrated into a processor. The method of circuit integration is not restricted to being LSI, and implementation may be done using dedicated circuitry or a general-purpose processor. In the event that advances in semiconductor technology result in integrated circuit technology that supplants LSI, an integrated circuit using that technology may be used.

From the foregoing, the present invention can be understood as follows. Although, as a convenience to facilitate an understanding of the present invention, reference symbols of the attached drawings are indicated in parentheses, there is no restriction to the illustrated aspects of the present invention.

A game apparatus (1, 1A) according to an aspect of the present invention has a symbol arrangement device (111, 111A, S100, S400, S406, S418, S450, S452, S464, S482) that arranges a plurality of symbols in a prescribed area (GS11, GS21), a replacement symbol drawing device (113, 113A, S200, S212, S220, S232, S242, S252, S500, S510, S522, S532, S544) that draws a symbol that is made the replacement target, a symbol replacement device (115, 115A, S206, S218, S224, S236, S246, S256, S506, S514, S526, S536, S548) that, after at least some of the plurality of symbols are arranged by the symbol arrangement device, replaces a symbol that becomes a replacement target symbol selected by a drawing by the replacement symbol drawing device with another symbol, and a win determination device (116, 116A, S102, S110, S408, S454, S472) that makes a win determination based on the disposition of symbols arranged in at least a part of a prescribed area after symbol replacement by the symbol replacement device.

According to the configuration, because the game apparatus randomly changes the symbol that becomes the replacement target symbol at the time of symbol replacement, it can impart unexpectedness or variety regarding the symbol replacement.

An aspect of the present invention is the game apparatus, wherein the replacement symbol drawing device (113, 113A, S200, S500) draws the type of symbol to be the replacement target symbol from among a plurality of types of symbols.

According to the configuration, because the game apparatus randomly changes the type of symbol that becomes the replacement target symbol at the time of symbol replacement, it can impart unexpectedness or variety regarding the symbol replacement.

An aspect of the present invention is the game apparatus, wherein the replacement symbol drawing device (113, 113A, S210, S212) draws the number of types of symbols that become replacement target symbols and draws that number of types of symbols from the plurality of types of symbols.

According to the configuration, because the game apparatus randomly changes the number of types of symbol that become replacement target symbols, it can impart variety regarding the symbol replacement.

An aspect of the present invention is the game apparatus, wherein the replacement symbol drawing device (113, 113A, S220, S510) draws the position of a symbol that becomes the replacement target symbol from among a prescribed area.

According to the configuration, because the game apparatus randomly changes the position of a symbol that becomes the replacement target symbol at the time of symbol replacement, it can impart unexpectedness or variety regarding the symbol replacement.

An aspect of the present invention is the game apparatus, wherein the replacement symbol drawing device, of the prescribed area, draws the number of positions of symbols to become the replacement target symbols and draws that number of positions.

According to the configuration, because the game apparatus randomly changes the positions of symbols to become the replacement target symbol at the time of symbol replacement and also changes the number of those positions, it can impart unexpectedness regarding the symbol replacement.

An aspect of the present invention is the game apparatus further including an alternative symbol drawing device (114, 114A, S202, S214, S222, S234, S244, S254, S502, S512, S524, S534, S546) that draws the other symbol that replaces the replacement target symbol.

According to the configuration, because the game apparatus randomly changes not only the symbol to become the replacement target symbol at the time of symbol replacement, but also the other symbol that replaces the replacement target symbol, it can impart unexpectedness or variety regarding the symbol replacement.

An aspect of the present invention is the game apparatus, wherein the replacement symbol drawing device draws the type of the other symbol that replaces the symbol that becomes the replacement target symbol.

According to the configuration, because the game apparatus randomly changes the type of the other symbol that replaces the symbol that becomes the replacement target symbol, it can impart unexpectedness or variety regarding the symbol replacement.

An aspect of the present invention is a game apparatus, wherein the alternative symbol drawing device (114, 114A, S214) draws, as the type of the other symbol, a type of symbol that exists in the same number as or is less numerous than the type of symbol that becomes the replacement target symbol.

According to the configuration, because the game apparatus replaces a plurality of types of symbol included in a prescribed area with a symbol of a type that is less numerous, it can make it easier for a win to occur and impart variety to the game progression.

An aspect of the present invention is the game apparatus, wherein the alternative symbol drawing device draws, as the type of the other symbol, a type of symbol having a value that is the same as or higher than a symbol that becomes the replacement target symbol.

According to the configuration, because the game apparatus replaces a symbol that becomes the replacement target symbol with a symbol having a higher value, it can impart variety to the game progression, such as increasing the disbursement when a win occurs.

An aspect of the present invention is the game apparatus that further has a replacement condition determination device that determines whether or not a replacement condition that permits replacement of a symbol by the symbol replacement device is satisfied, wherein the replacement symbol drawing device draws a symbol to be the replacement target symbol if the replacement condition is satisfied.

According to the configuration, because the game apparatus performs symbol replacement only when the replacement condition is satisfied, it can impart unexpectedness or variety to the game progression.

An aspect of the present invention is the game apparatus (1A), wherein the prescribed area includes an area in which a first replacement condition is set and an area in which a second replacement condition is set, the replacement condition determination device (112A) determines whether or not each of the first replacement condition and the second replacement condition have been satisfied and, if either of the first replacement condition and the replacement condition is satisfied, the alternative symbol drawing device (113A) draws the symbol that is made the replacement target symbol regarding the area in which the replacement condition is satisfied.

According to the configuration, because the game apparatus can set different replacement condition for each area, it can impart unexpectedness or variety regarding the symbol replacement.

An aspect of the present invention is the game apparatus (1A), wherein the symbol replacement device (115A), with different respective timings with regard to the area in which the first replacement condition is set and the area in which the second replacement condition is set, replaces a symbol that becomes the replacement target symbol and was selected by drawing by the replacement symbol drawing device with another symbol.

According to the configuration, symbol replacement can be done with timings suited to each area.

An aspect of the present invention is the game apparatus, wherein the win determination device makes a win determination both before and after symbol replacement.

According to the configuration, because it because the opportunities for a win determination increase and the chance for a win to occur increases, the game apparatus can impart variety to the game progression.

An aspect of the present invention is the game apparatus, wherein the prescribed area includes an area in which a win determination is made and an area in which a win determination is not made, and which further has a symbol moving device (118A) that moves a symbol arranged in the area in which a win determination is not made into the area in which a win determination is made, and wherein the symbol replacement device (115A), after a symbol is arranged in the area in which the win determination is not made and also before a symbol is moved by the symbol moving device, performs symbol replacement in the area in which the win determination is made.

According to the configuration, because the game apparatus can move a symbol arranged in the area in which the win determination is not made with a symbol having a greater effect or higher value before the symbol is moved into the area in which the win determination is made, the game apparatus can impart variety to the game progression.

An aspect of the present invention is the game apparatus, wherein the replacement condition determination device determines whether or not the replacement condition is satisfied, based on symbols arranged in at least a part of the prescribed area.

According to the configuration, because the game apparatus can perform symbol replacement in accordance with the disposition of symbols in the slot machine game, it can heighten the interest in the game.

An aspect of the present invention is the game apparatus (1A), wherein the replacement condition determination device (112A, S402, S468, S700 to S706, S720 to S726), if a specific symbol is arranged in at least a part of the prescribed area, updates a prescribed parameter and determines whether or not the replacement condition is satisfied, based on a comparison between the prescribed parameter and a prescribed reference value.

According to the configuration, the game apparatus can heighten the enjoyment in the game regarding satisfying the replacement condition.

An aspect of the present invention is the game apparatus, further including a display control device (117, 117A) that, after displaying one drawing result regarding the result of the drawing by the alternative symbol drawing device and the result of the drawing by the replacement symbol drawing device, displays the other drawing result.

According to the configuration, because the game apparatus displays one drawing result and then displays the other drawing result, it can impart a feeling of expectation to the player before the final drawing result is displayed, thereby enabling a heightening of interest in the game.

A program according to an aspect of the present invention is a program for causing a computer to function as the game apparatus described above.

According to the configuration, because the program that causes a computer to function as the game apparatus randomly changes the symbol that becomes the replacement target symbol at the time of a symbol replacement, it can impart unexpectedness or variety regarding the symbol replacement.

A game execution method according to an aspect of the present invention has a symbol arranging step of arranging a plurality of symbols in a prescribed area, a replacement symbol drawing step of drawing a symbol that becomes a replacement target symbol, a symbol replacing step that, after the symbol arrangement device arranging at least some of the plurality of symbols, replaces the symbol selected by the drawing by the replacement symbol drawing step with another symbol, and a win determining step that makes a win determination, based on the disposition of symbols arranged in at least a part of the prescribed area after the symbol replacement by the symbol replacing step.

According to the configuration, because the game execution method randomly changes the symbol to become the replacement target symbol at the time of symbol replacement, it can impart unexpectedness or variety regarding the symbol replacement.

Each element or device for the game apparatus described above can be implemented by hardware with or without software. In some cases, the game apparatus may be implemented by one or more hardware processors and one or more software components wherein the one or more software components are to be executed by the one or more hardware processors to implement each element or device for the game apparatus. In some other cases, the game apparatus may be implemented by a system of circuits or circuitry configured to perform each operation of each element or device for the game apparatus.

The systems and methods in the above-described embodiments may be deployed in part or in whole through a machine or circuitry that executes computer software, software components, program codes, and/or instructions on one or more processors. The one or more processors may be part of a general-purpose computer, a server, a cloud server, a client, network infrastructure, mobile computing platform, stationary computing platform, or other computing platform. One or more processors may be any kind of computational or processing device or devices which are capable of executing program instructions, codes, binary instructions and the like. The one or more processors may be or include a signal processor, digital processor, embedded processor, microprocessor or any variants such as a co-processor, for example, math co-processor, graphic co-processor, communication co-processor and the like that may directly or indirectly facilitate execution of program codes or program instructions stored thereon. In addition, the one or more processors may enable execution of multiple programs, threads, and codes. The threads may be executed simultaneously to enhance the performance of the one or more processors and to facilitate simultaneous operations of the application. Program codes, program instructions and the like described herein may be implemented in one or more threads. The one or more processors may include memory that stores codes, instructions and programs as described herein. The processor may access a non-transitory processor-readable storage medium through an interface that may store codes, instructions and programs as described herein and elsewhere. The non-transitory processor-readable storage medium associated with the processor for storing programs, codes, program instructions or other type of instructions capable of being executed by the computing or processing device may include but may not be limited to one or more of a memory, hard disk, flash drive, RAM, ROM, CD-ROM, DVD, cache and the like.

A processor may include one or more cores that may enhance speed and performance of a multiprocessor. In some embodiments, the process may be a dual core processor, quad core processors, other chip-level multiprocessor and the like that combine two or more independent cores.

The methods and systems described herein may be deployed in part or in whole through a machine that executes computer software on a server, client, firewall, gateway, hub, router, or other such computer and/or networking hardware.

The software program may be associated with one or more client that may include a file client, print client, domain client, internet client, intranet client and other variants such as secondary client, host client, distributed client and the like. The client may include one or more of memories, processors, computer readable media, storage media, physical and virtual ports, communication devices, and interfaces capable of accessing other clients, servers, machines, and devices through a wired or a wireless medium, and the like. The programs or codes as described herein may be executed by the client. In addition, other devices required for execution of methods as described in this application may be considered as a part of the infrastructure associated with the client. The client may provide an interface to other devices including servers, other clients, printers, database servers, print servers, file servers, communication servers, distributed servers and the like. This coupling and/or connection may facilitate remote execution of program across the network. The networking of some or all of these devices may facilitate parallel processing of a program or method at one or more location. In addition, any of the devices attached to the client through an interface may include at least one storage medium capable of storing methods, programs, applications, code and/or instructions. A central repository may provide program instructions to be executed on different devices. In this implementation, the remote repository may act as a storage medium for program code, instructions, and programs.

The software program may be associated with one or more servers that may include a file server, print server, domain server, internet server, intranet server and other variants such as secondary server, host server, distributed server and the like. The server may include one or more of memories, processors, computer readable media, storage media, physical and virtual ports, communication devices, and interfaces capable of accessing other servers, clients, machines, and devices through a wired or a wireless medium, and the like. The methods, programs or codes as described herein may be executed by the server. In addition, other devices required for execution of methods as described in this application may be considered as a part of the infrastructure associated with the server. The server may provide an interface to other devices including clients, other servers, printers, database servers, print servers, file servers, communication servers, distributed servers, social networks, and the like. This coupling and/or connection may facilitate remote execution of program across the network. The networking of some or all of these devices may facilitate parallel processing of a program or method at one or more locations. Any of the devices attached to the server through an interface may include at least one storage medium capable of storing programs, codes and/or instructions. A central repository may provide program instructions to be executed on different devices. In this implementation, the remote repository may act as a storage medium for program codes, instructions, and programs.

The methods and systems described herein may be deployed in part or in whole through network infrastructures. The network infrastructure may include elements such as computing devices, servers, routers, hubs, firewalls, clients, personal computers, communication devices, routing devices and other active and passive devices, modules and/or components as known in the art. The computing and/or non-computing devices associated with the network infrastructure may include, apart from other components, a storage medium such as flash memory, buffer, stack, RAM, ROM and the like. The processes, methods, program codes, instructions described herein and elsewhere may be executed by one or more of the network infrastructural elements.

The methods, program codes, and instructions described herein may be implemented on a cellular network having multiple cells. The cellular network may either be frequency division multiple access (FDMA) network or code division multiple access (CDMA) network. The cellular network may include mobile devices, cell sites, base stations, repeaters, antennas, towers, and the like. The cell network may be a GSM, GPRS, 3G, EVDO, mesh, or other networks types.

The methods, programs codes, and instructions described herein and elsewhere may be implemented on or through mobile devices. The mobile devices may include navigation devices, cell phones, mobile phones, mobile personal digital assistants, laptops, palmtops, netbooks, pagers, electronic books readers, music players and the like. These devices may include, apart from other components, a storage medium such as a flash memory, buffer, RAM, ROM and one or more computing devices. The computing devices associated with mobile devices may be enabled to execute program codes, methods, and instructions stored thereon. Alternatively, the mobile devices may be configured to execute instructions in collaboration with other devices. The mobile devices may communicate with base stations interfaced with servers and configured to execute program codes. The mobile devices may communicate on a peer to peer network, mesh network, or other communications network. The program code may be stored on the storage medium associated with the server and executed by a computing device embedded within the server. The base station may include a computing device and a storage medium. The storage device may store program codes and instructions executed by the computing devices associated with the base station.

The computer software, program codes, and/or instructions may be stored and/or accessed on machine readable media that may include: computer components, devices, and recording media that retain digital data used for computing for some interval of time; semiconductor storage known as random access memory (RAM); mass storage typically for more permanent storage, such as optical discs, forms of magnetic storage like hard disks, tapes, drums, cards and other types; processor registers, cache memory, volatile memory, non-volatile memory; optical storage such as CD, DVD; removable media such as flash memory, for example, USB sticks or keys, floppy disks, magnetic tape, paper tape, punch cards, standalone RAM disks, Zip drives, removable mass storage, off-line, and the like; other computer memory such as dynamic memory, static memory, read/write storage, mutable storage, read only, random access, sequential access, location addressable, file addressable, content addressable, network attached storage, storage area network, bar codes, magnetic ink, and the like.

The methods, devices, apparatus, and systems described herein may transform physical and/or or intangible items from one state to another. The methods and systems described herein may also transform data representing physical and/or intangible items from one state to another.

The modules, engines, components, and elements described herein, including in flow charts and block diagrams throughout the figures, imply logical boundaries between the modules, engines, components, and elements. However, according to software or hardware engineering practices, the modules, engines, components, and elements and the functions thereof may be implemented on one or more processors, computers, machines through computer executable media, which are capable of executing program instructions stored thereon as a monolithic software structure, as standalone software modules, or as modules that employ external routines, codes, services, or any combination of these, and all such implementations may be within the scope of the present disclosure. Examples of such machines may include, but is not limited to, personal digital assistants, laptops, personal computers, mobile phones, other handheld computing devices, medical equipment, wired or wireless communication devices, transducers, chips, calculators, satellites, tablet PCs, electronic books, gadgets, electronic devices, devices having artificial intelligence, computing devices, networking equipment, servers, routers, processor-embedded eyewear and the like. Furthermore, the modules, engines, components, and elements in the flow chart and block diagrams or any other logical component may be implemented on one or more machines, computers or processors capable of executing program instructions. Whereas the foregoing descriptions and drawings to which the descriptions have been referred set forth some functional aspects of the disclosed systems, no particular arrangement of software for implementing these functional aspects should be inferred from these descriptions unless explicitly stated or otherwise clear from the context. It will also be appreciated that the various steps identified and described above may be varied, and that the order of steps may be adapted to particular applications of the techniques disclosed herein. All such variations and modifications are intended to fall within the scope of this disclosure. The descriptions of an order for various steps should not be understood to require a particular order of execution for those steps, unless required by a particular application, or explicitly stated or otherwise clear from the context.

The methods and/or processes described above, and steps thereof, may be realized in hardware, software or any combination of hardware and software suitable for a particular application. The hardware may include a general purpose computer and/or dedicated computing device or specific computing device or particular aspect or component of a specific computing device. The processes may be realized in one or more microprocessors, microcontrollers, embedded microcontrollers, programmable digital signal processors or other programmable device, along with internal and/or external memory. The processes may also, or instead, be embodied in an application specific integrated circuit, a programmable gate array, programmable array logic, or any other device or combination of devices that may be configured to process electronic signals. It will further be appreciated that one or more of the processes may be realized as a computer executable code capable of being executed on a machine readable medium.

The computer executable code may be created using a structured programming language such as C, an object oriented programming language such as C++, or any other high-level or low-level programming language (including assembly languages, hardware description languages, and database programming languages and technologies) that may be stored, compiled or interpreted to run on one of the above devices, as well as heterogeneous combinations of processors, processor architectures, or combinations of different hardware and software, or any other machine capable of executing program instructions.

Thus, in one aspect, each method described above and combinations thereof may be embodied in computer executable code that, when executing on one or more computing devices, performs the steps thereof. In another aspect, the methods may be embodied in systems that perform the steps thereof, and may be distributed across devices in a number of ways, or all of the functionality may be integrated into a dedicated, standalone device or other hardware. In another aspect, the means for performing the steps associated with the processes described above may include any of the hardware and/or software described above. All such permutations and combinations are intended to fall within the scope of the present disclosure.

While certain embodiments of the present inventions have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A game apparatus comprising:

a display device having a game screen having at least a main area, in which a win determination is performed, a reserve area in which the win determination is not performed, and a replacement drawing area for displaying a symbol drawing presentation when drawing at least one replacement target symbol to be replaced by another symbol in the main area;

a symbol arrangement device configured to arrange a first plurality of symbols in the main area and a second plurality of symbols in the reserve area;

the symbol arrangement device being configured to delete a symbol of the first plurality of symbols arranged in the main area, if a deletion condition regarding the symbol arranged in the main area is satisfied, the symbol arrangement device being configured to move a movable symbol to a deletion position at which the deleted symbol had been arranged in the main area, if the movable symbol is in the main area;

a symbol moving device configured to move, to the deletion position at which the deleted symbol had been arranged in the main area, a symbol of the second plurality of symbols in the reserve area if any movable symbol to the deletion position is not in the main area;

a replacement symbol drawing device configured to draw at least one replacement target symbol to be replaced in the main area, while the display device is displaying the symbol drawing presentation in the replacement drawing area;

a symbol replacement device configured to replace, with at least alternative symbol, the at least one replacement target symbol that was drawn in the main area, after the symbol arrangement device arranged at least one of the plurality of symbols in the main area;

the symbol replacement device configured to perform the symbol replacement among the second plurality of symbols in the reserve area, after the symbol arrangement device arranged the second plurality of symbols in the reserve area and before the symbol moving device moves, to the deletion position in the main area, the symbol in the reserve area; and a win determination device configured to perform a win determination based at least in part on an arrangement of symbols which are in at least a part of the main area, after the symbol replacement device replaced, by the at least alternative symbol, the at least one replacement target symbol that was drawn.

2. The game apparatus according to claim 1, wherein the replacement symbol drawing device is configured to draw the at least one replacement target symbol from symbols of different types in the main area.

3. The game apparatus according to claim 2, wherein the replacement symbol drawing device is configured to draw the number of types of the replacement target symbols in the main area, and draw symbols of the drawn number of types from the plurality of symbols in the main area.

4. The game apparatus according to claim 1, wherein the replacement symbol drawing device is configured to draw at least one position of the at least one replacement target symbol in the main area.

5. The game apparatus according to claim 4, wherein the replacement symbol drawing device is configured to draw the number of the at least one position of the at least one replacement target symbol in the main area, and draw the at least one positions of which number is the drawn number.

6. The game apparatus according to claim 1, further comprising:

an alternative symbol drawing device configured to draw the at least alternative symbol which is to be replaced for the at least one replacement target symbol.

7. The game apparatus according to claim 6, wherein the alternative symbol drawing device is configured to draw a type of the at least alternative symbol which is to be replaced for the at least one replacement target symbol.

8. The game apparatus according to claim 7, wherein the alternative symbol drawing device is configured to draw types of the at least one alternative symbols, the number of types of the at least one alternative symbols is equal to or smaller than the number of the types of the at least one replacement target symbol.

9. The game apparatus according to claim 7, wherein the alternative symbol drawing device is configured to draw a type of the alternative symbol which is equal to or higher in value than the at least one replacement target symbol.

10. The game apparatus according to claim 1, further comprising:

a replacement condition determination device configured to determine whether there is satisfied a replacement condition for the symbol arrangement device to replace symbol, wherein the replacement symbol drawing device is configured to draw the at least one replacement target symbol in case that the replacement condition determination device determined that the replacement condition is satisfied.

11. The game apparatus according to claim 10, wherein the main area includes a first area on which a first replacement condition is set as the replacement condition and a second area on which a second replacement condition is set as the replacement condition, wherein the replacement condition determination device is configured to determine whether the first replacement condition is satisfied and whether the second replacement condition is satisfied, wherein the replacement symbol drawing device is configured to draw the at least one replacement target symbol in the first area in case that the replacement condition determination device determined that the first replacement condition is satisfied, and wherein the replacement symbol drawing device is configured to draw the at least one replacement target symbol in the second area in case that the replacement condition determination device determined that the second replacement condition is satisfied.

12. The game apparatus according to claim 11, wherein the symbol replacement device is configured to replace, with at least alternative symbol, the at least one replacement target symbol that was drawn in the first area at a first timing, wherein the symbol replacement device is configured to replace, with at least alternative symbol, the at least one replacement target symbol that was drawn in the second area at a second timing which is different from the first timing.

13. The game apparatus according to claim 1, wherein the win determination device is configured to perform the win determinations before and after the symbol replacement device replaces, with at least alternative symbol, the at least one replacement target symbol that was drawn.

14. The game apparatus according to claim 10, wherein the replacement condition determination device is configured to determine whether the replacement condition is satisfied, based at least in part on symbols which are arranged in at least a part of the main area by the symbol arrangement device.

15. The game apparatus according to claim 14, wherein the replacement condition determination device is configured to update at least one parameter in case that the symbol arrangement device arranges specific symbols at least a part of the main area, and to determine whether the replacement condition is satisfied, based at least in part on a comparison between the at least one parameter and at least one predefined reference value.

16. The game apparatus according to claim 6, further comprising:

a display control device configured to have a display device display a first result of drawing the at least one alternative symbol and a second result of drawing the at least one replacement symbol, wherein a first one of the first and second results is displayed before a second one of the first and second results is displayed.

17. A gaming method comprising:

arranging, by a symbol arrangement device, a first plurality of symbols in a main area of a game screen of a display device, where the game screen having a reserve area, where in the main area a win determination is performed and in the reserve area the win determination is not performed and a replacement drawing area for displaying a symbol drawing presentation when drawing at least one replacement target symbol to be replaced by another symbol in the main area;

deleting, by the symbol arrangement device, a symbol of the first plurality of symbols arranged in the main area, if a deletion condition regarding the symbol arranged in the main area is satisfied;

moving, by the symbol arrangement device, a movable symbol to a deletion position at which the deleted symbol had been arranged in the main area, if the movable symbol is in the main area;

moving, by a symbol moving device, to the deletion position at which the deleted symbol had been arranged in the main area, a symbol of the second plurality of symbols in the reserve area if any movable symbol to the deletion position is not in the main area;

drawing, by a replacement symbol drawing device, at least one replacement target symbol to be replaced in the main area, while the display device is displaying the symbol drawing presentation in the replacement drawing area;

replacing, by a symbol replacement device, with at least alternative symbol, the at least one replacement target symbol that was drawn in the main area, after at least one of the plurality of symbols was arranged in the main area;

performing, by the symbol replacement device, the symbol replacement among the second plurality of symbols in the reserve area, after the symbol arrangement device arranged the second plurality of symbols in the reserve area and before the symbol moving device moves, to the deletion position in the main area, the symbol in the reserve area; and performing, by a win determination device, a win determination based at least in part on an arrangement of symbols which are in at least a part of the main area, after the at least one replacement target symbol that was drawn is replaced by the at least alternative symbol.

18. A non-transitory computer readable medium that stores a computer program to be executed by a computer to perform a gaming method comprising:

arranging a first plurality of symbols in a main area of a game screen of a display device, where the game screen having a reserve area, wherein in the main area a win determination is performed and in the reserve area the win determination is not performed and a replacement drawing area for displaying a symbol drawing presentation when drawing at least one replacement target symbol to be replaced by another symbol in the main area;

deleting a symbol of the first plurality of symbols arranged in the main area, if a deletion condition regarding the symbol arranged in the main area is satisfied;

moving a movable symbol to a deletion position at which the deleted symbol had been arranged in the main area, if the movable symbol is in the main area;

moving, to the deletion position at which the deleted symbol had been arranged in the main area, a symbol of the second plurality of symbols in the reserve area if any movable symbol to the deletion position is not in the main area;

drawing at least one replacement target symbol to be replaced in the main area, while displaying the symbol drawing presentation in the replacement drawing area;

replacing, with at least alternative symbol, the at least one replacement target symbol that was drawn in the main area, after at least one of the plurality of symbols was arranged in the main area;

performing the symbol replacement among the second plurality of symbols in the reserve area, after the symbol arrangement device arranged the second plurality of symbols in the reserve area and before the symbol moving device moves, to the deletion position in the main area, the symbol in the reserve area; and performing a win determination based at least in part on an arrangement of symbols which are in at least a part of the main area, after the at least one replacement target symbol that was drawn is replaced by the at least alternative symbol.

* * * * *